US008510918B2

(12) United States Patent
Shilale et al.

(10) Patent No.: US 8,510,918 B2
(45) Date of Patent: Aug. 20, 2013

(54) CABLE TIE

(75) Inventors: Thomas Shilale, Douglas, MA (US); Charles J. Burout, III, Bedford, NH (US); David L. Schuttler, Townsend, MA (US)

(73) Assignee: Avery Dennison Corporation, Pasadena, CA (US)

( * ) Notice: Subject to any disclaimer, the term of this patent is extended or adjusted under 35 U.S.C. 154(b) by 572 days.

(21) Appl. No.: 12/660,174

(22) Filed: Feb. 22, 2010

(65) Prior Publication Data

US 2010/0223763 A1 Sep. 9, 2010

Related U.S. Application Data

(60) Provisional application No. 61/208,336, filed on Feb. 23, 2009.

(51) Int. Cl.
*B65D 63/10* (2006.01)

(52) U.S. Cl.
USPC ..... 24/16 PB

(58) Field of Classification Search
USPC ..... 24/16 PB, 16 R, 17 A, 17 AP, 30.5 R, 24/265 BC, 265 EC, 300, 301; 248/74.3; 264/16 PB, 148, 151, 153, 154, 250, 267, 264/274
See application file for complete search history.

(56) References Cited

U.S. PATENT DOCUMENTS 3,874,034 A * 4/1975 Clayton ..... 24/30.5 P
3,996,646 A * 12/1976 Caveney ..... 24/16 PB
4,000,229 A * 12/1976 Wainer ..... 264/437
4,001,898 A * 1/1977 Caveney ..... 24/16 PB
4,227,668 A * 10/1980 Ernst ..... 248/317
4,466,159 A * 8/1984 Burrage ..... 24/16 PB
4,676,535 A * 6/1987 Mautner ..... 292/320
4,726,115 A 2/1988 Hartman
4,783,886 A * 11/1988 Koppe ..... 24/30.5 S
4,862,561 A 9/1989 Lichtenberg
5,028,225 A 7/1991 Staheli
5,121,524 A 6/1992 Mortensen
5,146,654 A * 9/1992 Caveney et al. ..... 24/16 PB
5,377,387 A * 1/1995 Freed ..... 24/16 PB
5,467,507 A * 11/1995 Marsh et al. ..... 24/298

(Continued)

OTHER PUBLICATIONS

"Tensile Property Testing of Plastics", WayBackMachine date Feb 12, 2008; http://web.archive.org/web/20080212032316/http://www.matweb.com/reference/tensilestrength.aspx, 2 pages (Retrieved Nov. 5, 2012).*

*Primary Examiner* — Robert J Sandy
*Assistant Examiner* — Louis Mercado
(74) *Attorney, Agent, or Firm* — Kriegsman & Kriegsman

(57) ABSTRACT

A two-piece cable tie for bundling a plurality of objects, such as cables or wires, includes a front portion that is insert-molded onto a connective segment of a flexible strap, the front portion being constructed out of a higher tensile strength plastic than the strap to maximize the load rating of the tie without significantly increasing material costs. In one embodiment, the connective segment of the strap is shaped to include a pair of opposing semi-circular cutouts in its side rails to enhance the strength of mechanical bonding achieved by the front portion around the strap. In addition, the connective segment is shaped to include a circular hole that is offset longitudinally from the opposing cutouts, the diameter of the circular opening not exceeding 40% of the maximum width of the strap to ensure the integrity and strength of the strap along the entirety of its length.

17 Claims, 14 Drawing Sheets

(56) References Cited

U.S. PATENT DOCUMENTS

| | | | | |
|---|---|---|---|---|
| 5,495,645 | A * | 3/1996 | Suzuki et al. | 24/30.5 S |
| 5,571,296 | A * | 11/1996 | Barber et al. | 51/295 |
| 5,669,111 | A * | 9/1997 | Rohaly | 24/16 PB |
| 5,774,945 | A * | 7/1998 | Ginocchio | 24/16 R |
| 5,785,216 | A | 7/1998 | Gouldson et al. | |
| 6,138,327 | A * | 10/2000 | Powell et al. | 24/16 PB |
| 6,220,562 | B1 * | 4/2001 | Konkle | 248/500 |
| 6,240,602 | B1 | 6/2001 | Geiger | |
| 6,532,631 | B2 | 3/2003 | Rohaly et al. | |
| 6,543,094 | B2 * | 4/2003 | D'Addario | 24/16 PB |
| 6,588,074 | B2 | 7/2003 | Galkiewicz | |
| 6,863,855 | B2 | 3/2005 | Shilale | |
| 6,898,826 | B2 | 5/2005 | Draper et al. | |
| 6,928,701 | B2 | 8/2005 | Hutter, III | |
| 6,976,719 | B2 * | 12/2005 | Agayof et al. | 294/150 |
| 7,337,502 | B2 | 3/2008 | Mermelshtein | |
| 7,805,816 | B1 * | 10/2010 | Thorne et al. | 24/301 |
| 2004/0075299 | A1 | 4/2004 | Wieber et al. | |
| 2004/0094986 | A1 | 5/2004 | Landvik et al. | |
| 2004/0231110 | A1 | 11/2004 | Hutter, III | |
| 2005/0115028 | A1 * | 6/2005 | Cheung | 24/16 PB |
| 2006/0242800 | A1 * | 11/2006 | Pettersson | 24/16 PB |
| 2006/0254031 | A1 | 11/2006 | DeMik et al. | |

* cited by examiner

CABLE TIE

CROSS-REFERENCE TO RELATED APPLICATIONS

The present application claims the benefit under 35 U.S.C. 119(e) of U.S. provisional Patent Application Ser. No. 61/208,336, filed Feb. 23, 2009, the disclosure of which is incorporated herein by reference.

BACKGROUND OF THE INVENTION

The present invention relates generally to cable ties and relates more particularly to cables ties formed from two separately molded plastic components.

Cable ties, also known as bundling ties and harnessing devices, are well known devices commonly used in the art to couple together a plurality of elongated objects, such as wires or cables. One type of cable tie which is well known and widely used in the art comprises an elongated strap having an apertured head disposed at one end thereof. The opposite end of the elongated strap is typically shaped to define a tail of narrowed width adapted for insertion through the apertured head to form a closed loop. A plurality of serrations or teeth are formed along the length of the elongated strap, and an internal pawl (or locking tang) is disposed within the apertured head, the internal pawl being adapted to sequentially engage the serrations on the strap. In this manner, the engagement of the internal pawl with the serrated strap is used to lock the cable tie in a closed loop configuration.

Cable ties are typically formed by injection molding. More specifically, this typically involves the use of a two-piece mold into which the impression of one or more whole cable ties has been formed. Molten plastic, such as nylon, polypropylene or the like, is injected into the mold through a single opening or gate in the mold until the one or more impressions therein are filled. The molten plastic is then allowed to harden in the one or more impressions. The thus-formed cable ties are then removed from the mold.

Use of the aforementioned injection molding technique to construct cable ties suffers from a couple of notable drawbacks.

As a primary drawback, the above-described process involves molding the entirety of a cable tie through a single injection molding step. As a result, the length of the cable tie strap is limited by the size of its corresponding impression. Consequently, to make a variety of cable ties having straps of different lengths, it is generally necessary to use a plurality of different sized impressions. This typically results in the need for many differently-sized molds to be constructed. As can readily be appreciated, the provision of many differently-sized molds may be prohibited by cost as molds are very expensive to produce.

As a secondary drawback, because the above-described process requires that the entirety of the cable tie be formed at one time, cable ties having long strap lengths (i.e., several feet) require correspondingly large molds. Molds of such large size are particularly expensive to produce. In addition, because cable tie molds typically have only a single gate through which molten plastic is injected, the cycle time can be rather long as the molten plastic must travel through the single gate in the mold until it fills the entireties of all of the impressions. In addition, the aforementioned forcing of the molten plastic through the entireties of the impressions often results in some degradation of the molten plastic material, such degradation being undesirable.

Accordingly, it is known in the art for cables ties to be formed from two separately molded plastic components, this type of cable tie being commonly referred to in the art as a two-piece cable tie. Specifically, the head portion and the strap portion of each tie are independently formed through separate molding processes. In a subsequent or simultaneous step, the separately formed head and strap are permanently joined together to create a unitary finished product. Accordingly, various custom-length cable ties can be readily constructed without the use of uniquely-designed molds by (i) forming a plurality of straps, each strap preferably being of a considerable length, (ii) cutting each strap to a desired length and (iii) joining each re-dimensioned strap to a universal head. In this manner, it is to be understood that a plurality of different sized cable ties can be created using a single mold for each of the head portion and the strap portion, which is highly desirable.

There presently exists numerous methods in the art for joining together the separately formed head and strap portions of a two-piece cable tie.

As a first connection method, it is well known in the art for the head and strap portions of a two-piece cable tie to be permanently joined together by positioning one end of the strap on or within a portion of the head and, in turn, driving a metal rivet through the overlying segments. Even though a metal rivet adequately retains the head and strap portions of a two-piece cable tie together, it has been found that the cost associated with both the metal material requirement and the complex mechanical driving process renders the rivet connection method unfavorable for mass production.

As a second connection method, it is well known in the art for the head and strap portions of a two-piece cable tie to be permanently joined together using insert molding. For example, in U.S. Pat. No. 6,863,855 to T. Shilale (hereinafter the '855 patent), the disclosure of which is incorporated by reference, there is disclosed a method of constructing a two-piece cable tie which comprises the steps of (i) forming a length of strap material using a rotary extrusion process, (ii) cutting the length of strap material into individual straps of desired length, and (iii) insert molding a front portion, which includes the head, around one end of each individual strap.

The present inventors have found that two-piece cable ties of the type described in the '855 patent suffer from certain performance limitations. Specifically, the present inventors have found that two-piece cable ties of the type described in the '855 patent have a limited load rating. As defined herein, the "load rating" of a cable tie relates to the amount of force that the tie is able to exert/withstand as a closed loop around a bundle without experiencing failure. It has been found that cable tie failure typically occurs as a result of either (i) severance of the strap at some point along its length (referred to hereinafter simply as "strap failure"), (ii) disengagement of the pawl from the serrated strap (referred to hereinafter as "pawl failure"), and/or (iii) separation of the portion of the head that is insert-molded around the strap (referred to hereinafter as "insert-mold failure").

SUMMARY OF THE INVENTION

It is an object of the present invention to provide a new and improved cable tie.

It is another object of the present invention to provide a new and improved cable tie that is formed from two separately molded pieces.

It is yet another object of the present invention to provide a cable tie of the type described above that is specifically designed to maximize its load rating.

It is still another object of the present invention to provide a cable tie of the type as described above which has a limited number of parts and which is inexpensive to manufacture.

It is yet still another object of the present invention to provide a cable tie of the type as described above that overcomes at least some of the shortcomings associated with existing two-piece cable ties.

Accordingly, as one feature of the present invention, there is provided a cable tie comprising (a) a strap, the strap being an elongated flexible member that comprises a front end, a rear end, a top surface, a bottom surface and a pair of side members; the strap additionally comprising a connective segment at its front end, and (b) a front portion insert-molded onto the connective segment of the strap, the front portion comprising a head, the head being adapted to cooperate with the strap to form a locked closed loop, (c) wherein the front portion is constructed of a first plastic material and the strap is constructed of a second plastic material, the first plastic material having a tensile strength that is greater than the tensile strength of the second plastic material.

As another feature of the present invention, there is provided a cable tie comprising (a) a strap, the strap being an elongated flexible member that comprises a front end, a rear end, a top surface, a bottom surface and a pair of side members; the strap additionally comprising a connective segment at its front end, and (b) a front portion insert-molded onto the connective segment of the strap, the front portion comprising a head, the head being adapted to cooperate with the strap to form a locked closed loop, (c) wherein the connective segment of the strap is shaped to include a mechanical interlocking element to enhance the strength of the connection between the strap and the front portion, the mechanical interlocking element being in the form of at least one cutout formed into at least one side member in a spaced apart relationship from the front end of the strap.

As another feature of the present invention, there is provided a cable tie comprising (a) a strap, the strap being an elongated flexible member that comprises a front end, a rear end, a top surface, a bottom surface and a pair of side members; the strap additionally comprising a connective segment at its front end, and (b) a front portion insert-molded onto the connective segment of the strap, the front portion comprising a head, the head being adapted to cooperate with the strap to form a locked closed loop, (c) wherein the connective segment of the strap is shaped to include a mechanical interlocking element to enhance the strength of the connection between the strap and the front portion, the mechanical interlocking element being in the form of at least one at least one hole that is spaced in from each of the pair of side members, the maximum width of the hole being no greater than 40% of the width of the strap.

As another feature of the present invention, there is provided a cable tie comprising (a) a strap, the strap being an elongated flexible member that comprises a front end, a rear end, a top surface, a bottom surface and a pair of side members; the strap additionally comprising a connective segment at its front end, and (b) a front portion insert-molded onto the connective segment of the strap, the front portion comprising a head, the head being adapted to cooperate with the strap to form a locked closed loop, (c) wherein the connective segment of the strap is shaped to include a mechanical interlocking element to enhance the strength of the connection between the strap and the front portion, the mechanical interlocking element being in the form of first and second projections, the first projection protruding out from the top surface of the strap and the second projection protruding out from the bottom surface of the strap.

As another feature of the present invention, there is provided cable tie comprising (a) a front portion comprising a head and a tab, the head being shaped to define a strap accepting channel, the head comprising a locking member which is disposed to project into the strap accepting channel, and (b) a strap being an elongated flexible member that comprises a front end, a rear end, a top surface, a bottom surface and a pair of side rails, the rear end of the strap being sized and shaped to be both inserted into the strap accepting channel and engaged by the locking member, (c) wherein the front end of the strap is inserted molded onto the tab.

As another feature of the present invention, there is provided a cable tie comprising (a) a head, the head comprising a bottom wall, a top wall, a front wall, a rear wall, a left side wall and a right side wall that together define an elongated strap accepting channel, the head additionally comprising a locking member that is disposed to project into the strap accepting channel, and (b) a strap, the strap comprising a first end and a second end, the first end of the strap being formed onto the head, the strap being sized and shaped to be inserted into the strap accepting channel so that the cable tie forms a closed loop, the strap being adapted to be engaged by the locking member when the cable tie is formed into a closed loop, (c) wherein the portion of the bottom wall that extends between the strap accepting channel and the rear wall includes a relief area that is recessed in relation to the remainder of the bottom wall.

Additional objects, as well as features and advantages, of the present invention will be set forth in part in the description which follows, and in part will be obvious from the description or may be learned by practice of the invention. In the description, reference is made to the accompanying drawings which form a part thereof and in which is shown by way of illustration various embodiments for practicing the invention. The embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. In the drawings, wherein like reference numerals represent like parts:

FIG. 20(*b*) is a fragmentary, exploded, top plan view of the two-piece cable tie shown in FIG. 20(*a*);

FIG. 20(*c*) is an enlarged, fragmentary section view of the two-piece cable tie of FIG. 20(*b*) taken along lines 20-20;

FIG. 21(*b*) is a top plan view of the two-piece cable tie shown in FIG. 21(*a*);

FIG. 21(*c*) is a section view of the two-piece cable tie of FIG. 21(*b*) taken along lines 21-21;

FIG. 22(*b*) is a top plan view of the three-piece cable tie shown in FIG. 22(*a*);

FIG. 22(*c*) is a section view of the three-piece cable tie of FIG. 22(*b*) taken along lines 22-22;

FIG. 23(*b*) is a section view of the two-piece cable tie of FIG. 23(*a*) taken along lines 23-23, the cable tie being shown with its strap inserted into its head;

FIG. 24(*d*) is a section view of the front portion of FIG. 24(*c*) taken along lines 24-24;

FIG. 25(*b*) is a front plan view of the cable tie of FIG. 23(*b*) shown cinched around a bundle.

DETAILED DESCRIPTION OF PREFERRED EMBODIMENTS

Figure 1:
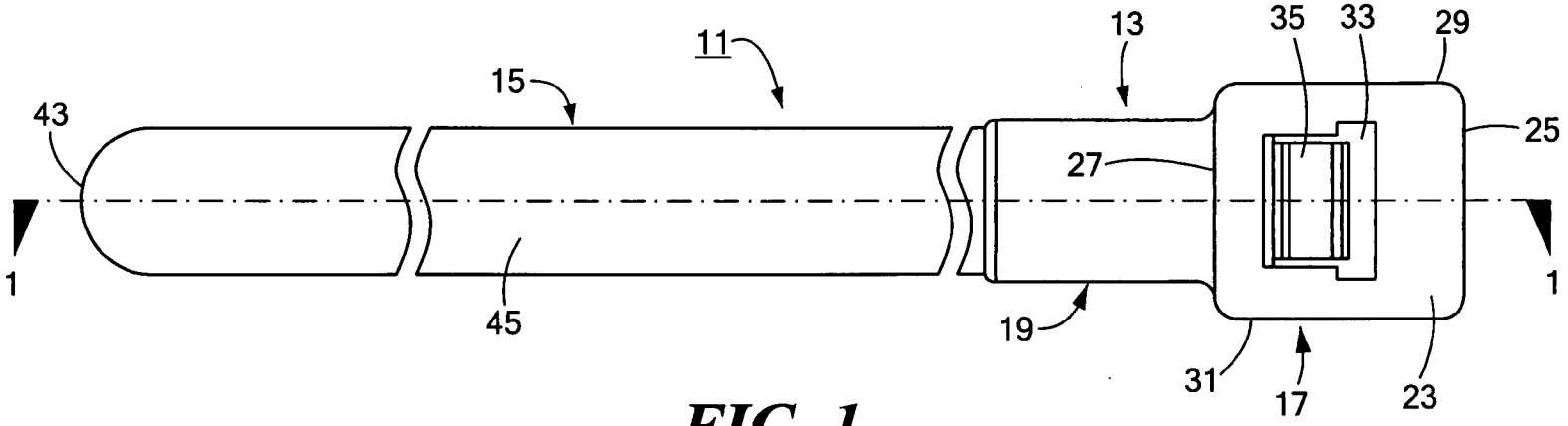
FIG. 1 is a fragmentary, top plan view of a cable tie constructed according to the teachings of the present invention.
Figure 2:
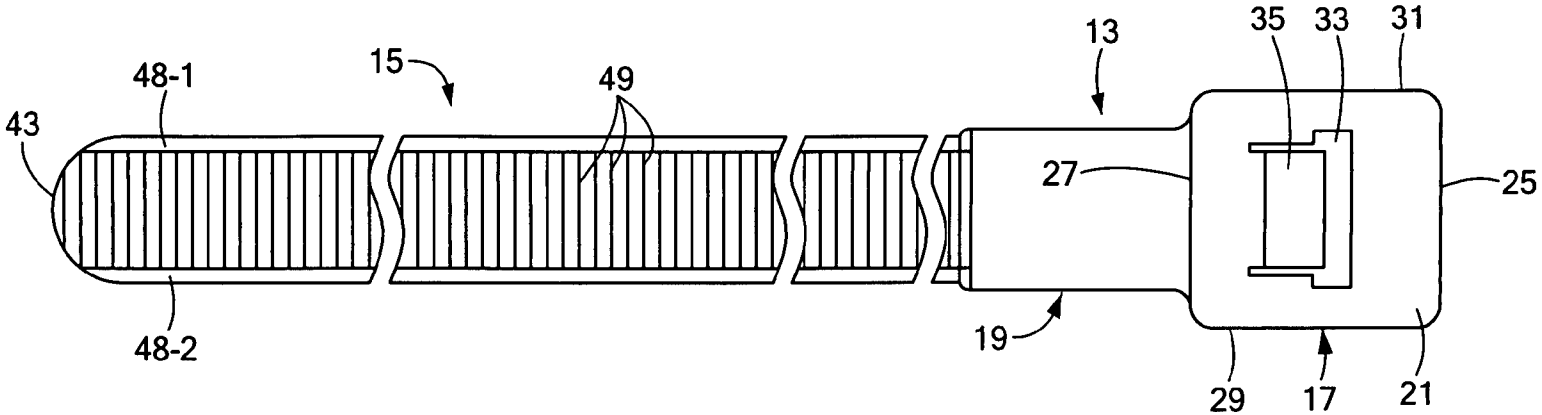
FIG. 2 is a fragmentary, bottom plan view of the cable tie shown in FIG. 1.

Referring now to FIGS. 1 and 2, there are shown various views of a cable tie constructed according to the teachings of the present invention, the cable tie being represented generally by reference numeral 11. In use, cable tie 11 can be formed into a locked closed loop in order to bundle together a plurality of objects, such as cables and/or wires.

The present inventors have determined that the failure of two-piece cable ties of the type described in the '855 patent most commonly occurs as a result of either pawl failure or insert-mold failure rather than strap failure. Accordingly, as will be described in greater detail below, cable tie 11 combines the basic design and method of manufacture of the two-piece cable disclosed in the '855 patent with certain design and manufacturing enhancements that result in an increased load rating, these enhancements serving as the primary novel features of the present invention. More specifically, the enhancements of the present invention provide cable tie 11 with a load rating that is considerably higher than the load rating associated with the two-piece cable tie disclosed in the '855 patent by both increasing (i) the strength of the pawl and (ii) the retentive strength established between the head and the strap through insert-molding, but without considerably increasing the cost associated with the forming the strap, which is highly desirable.

Construction of Cable Tie 11

Cable tie 11 comprises a front portion 13 and a strap 15. As will be described further below, front portion 13 and strap 15 are formed through separate molding processes, each component preferably being molded using a plastic with unique tensile characteristics. To permanently join front portion 13 and strap 15 together to create unitary tie 11, front portion 13 is insert molded onto one end of strap 15.

Figure 4:
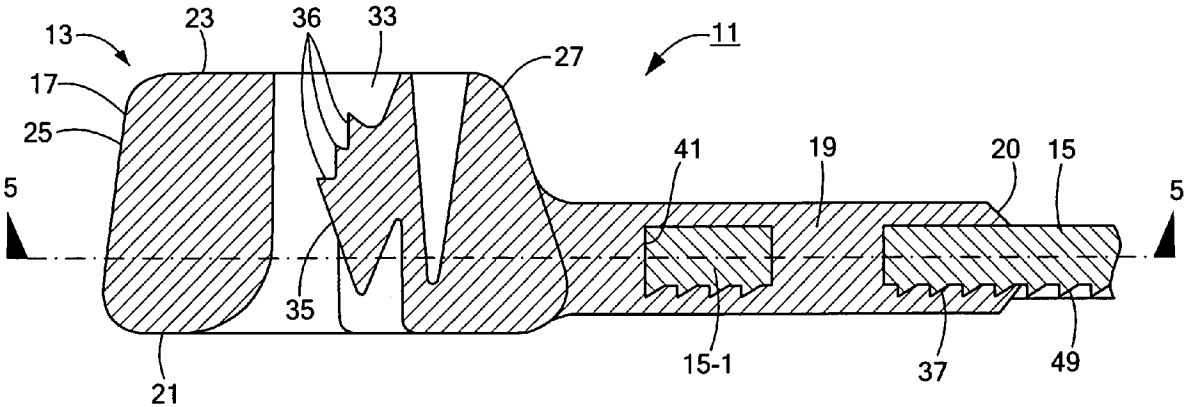
FIG. 4 is an enlarged, fragmentary section view of the cable tie of FIG. 1 taken along line 1-1.

As seen most clearly in FIGS. 1, 2 and 4, front portion 13 is a unitary member that comprises a head 17 and a neck 19.

Head 17 is in the form of an enlarged, rectangular block that is shaped to include a bottom wall 21, a top wall 23, a front wall 25, a rear wall 27, a left side wall 29, a right side wall 31 and an elongated channel 33 which extends through head 17 from bottom wall 21 to top wall 23. Head 17 is further shaped to include a locking tang, or pawl, 35 that extends into channel 33, pawl 35 being shaped to include a plurality of teeth 36 that are adapted to lockably engage strap 15, as will be described further below.

Neck 19, which extends rearwardly from rear wall 27, is in the form of a flattened, rectangular tab that includes a slightly tapered free end 20. It is to be understood that because front portion 13 is insert molded around strap 15, strap 15 creates a generally rectangular slot 37 in neck 19 that extends in from free end 20, the particular dimensions of slot 37 being identical to the outer configuration of the end of strap 15 around which front portion 13 is insert molded.

As seen most clearly in FIGS. 1-5, strap 15 is constructed as elongated, generally rectangular strip that is highly flexible in nature, strap 15 comprising a front end 41, a rear end 43, a substantially flat top surface 45, a bottom surface 47 and a pair of opposing, longitudinally extending side members, or rails, 48-1 and 48-2. A plurality of ratchet-shaped teeth 49 are integrally formed into bottom surface 47 along the entirety of its length, each tooth 49 extending laterally across bottom surface 47 between side members 48-1 and 48-2.

Rear end, or tail, 43 is rounded to facilitate its insertion through bottom wall 21 of head 17. Specifically, in use, tail 43 is inserted through channel 33 in head 17 to form a closed loop. As tail 43 is advanced through channel 33, the closed loop decreases in size, with teeth 36 on locking pawl 35 sequentially engaging teeth 49 on strap 15 in such a manner so as to preclude rearward displacement of strap 15 from head 17.

As shown in FIG. 4, front portion 13 is insert-molded onto front end 41 of strap 15, the portion of strap 15 at front end 41 around which front end 13 is insert molded being referred to herein simply as connective segment 15-1 of strap 15. As will be described in greater detail below, connective segment 15-1 of strap 15 is provided with one or more mechanical interlocking elements around which insert-molding occurs. As can be appreciated, the inventors of the present invention have determined that by increasing the surface area of the region of mechanical interlock between front portion 13 and strap 15, the retentive strength established therebetween is similarly increased, which is a principal object of the present invention.

As an example, teeth 49 on connective segment 15-1 of strap 15 act as mechanical interlocking elements around which insert-molding occurs.

Figure 3A:
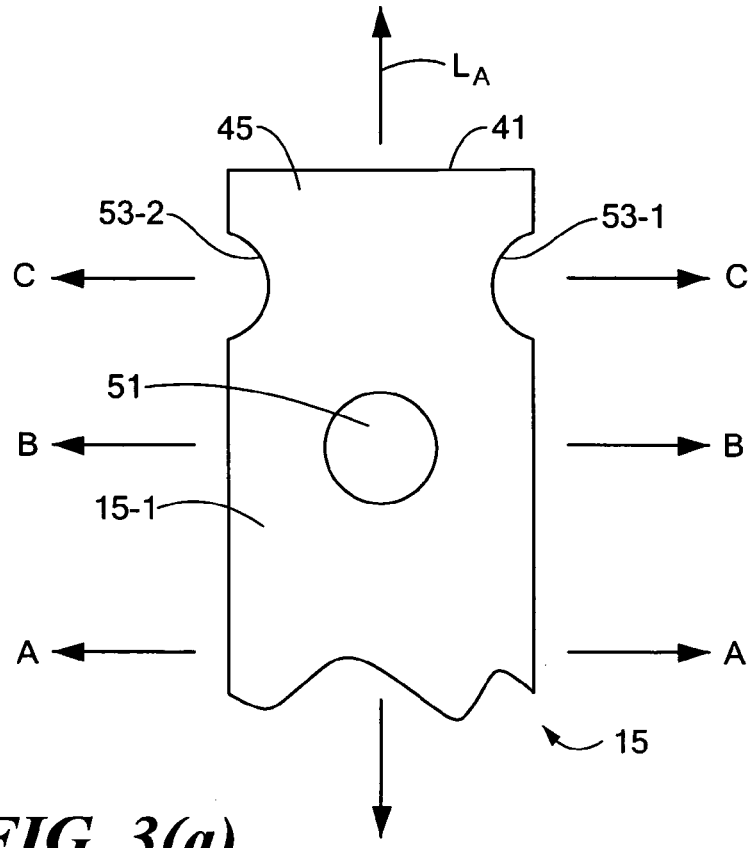
FIGS. 3 (*a*) and 3(*b*) are enlarged, fragmentary top and bottom views, respectively, of the strap of the cable tie shown in FIG. 1.
Figure 3B:
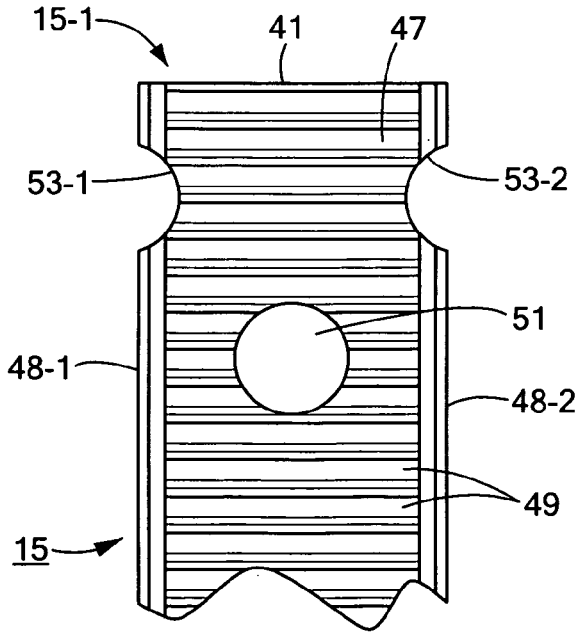

As another example, referring now to FIGS. 3(*a*) and 3(*b*), connective segment 15-1 of strap 15 is shaped to define a transverse hole 51 that is generally circular in cross-section. As can be seen, transverse hole 51 is spaced adequately in from front end 41 and is preferably centered evenly between side members 48-1 and 48-2 to maximize the strength of strap 15 through hole 51. It is important to note that the maximum width (i.e., diameter) of hole 51 is preferably no greater than 40% of the width of strap 15 to ensure that the strength and integrity of strap 15 is adequately maintained. To the contrary, the diameter of the circular hole formed in the strap of the two-piece cable tie disclosed in the '855 patent is approximately 50% of the width of the strap and, as such, creates a significant area of weakness in the strap, which is highly undesirable.

As yet another example, a pair of semi-circular cutouts 53-1 and 53-2 are formed into side members 48-1 and 48-2, respectively. As can be seen, cutouts 53-1 and 53-2 are spaced equally in from front end 41 so as to form mirror images of one another about the central longitudinal axis $L_A$.

As will be described in greater detail below, the inclusion of all of the aforementioned mechanical interlocking elements significantly increases the surface area of the region of mechanical interlock between front portion 13 and strap 15 which, in turn, increases the retentive strength established therebetween, thereby minimizing the likelihood of insert-mold failure in tie 11, which is a principal object of the present invention.

Method of Manufacturing Cable Tie 11

In accordance with the teachings of the present invention, cable tie 11 is preferably manufactured by (i) forming strap 15 and then, in a subsequent step, (ii) insert-molding front portion 13 around front end 41 of strap 15 to yield the finished product. All of the above steps may be performed manually; alternatively, some or all of these steps may be automated. A largely automated method of manufacture is highly desirable for cost purposes and may be of the type as described in the '855 patent, the disclosure of which is incorporated by reference.

Specifically, strap 15 is preferably formed by continuously molding a length of strap material using a rotary extrusion process, cutting the strap material to a desired length and then cutting, punching or otherwise shaping the ends as desired. However, it is to be understood that the present invention is not limited to the above method of forming strap 15 and that strap 15 may be formed using a variety of other methods, including, for example, non-rotary extrusion and injection molding.

As noted above, once strap 15 has been formed, front portion 13 is then insert-molded around front end 41 of strap 15. This may be done by manually inserting strap 15 into a mold having an impression for front portion 13, injecting molten plastic into the mold, allowing the molded product to harden and then removing the molded product from the mold, with one or more of the aforementioned steps being automated in nature.

Material Selection Enhancement to Minimize Pawl Failure

As noted above, the inventors have discovered that two-piece cable ties of the type described in the '855 patent are more susceptible to experiencing pawl than strap failure. Because higher tensile strength plastics are typically more expensive than their lower tensile strength counterparts, it is a primary feature of the present invention that front portion 13 of cable tie 11 be constructed of a higher tensile strength material than strap 15. More specifically, the inventors have determined that by constructing front portion 13 of cable tie 11 using a plastic material with a tensile strength that is at least 1.1 times greater than the tensile strength of the plastic material used to construct strap 13, the resultant load rating of cable tie 11 can be maximized without considerably increasing the overall cost of its manufacture.

Preferably, front portion 13 is constructed of a nylon material having a tensile strength in the range from 4,800 psi to 24,000 psi. However, it is to be understood that front portion 13 could be manufactured using alternative types of plastics (e.g., polypropylene, polyethylene, polyamide (PA), acetal, polytetrafluoroethylene (PTFE) or a combination of recycled plastic materials, such as nylon and polyethylene terephthalate (PET)) with a similar tensile strength range without departing from the spirit of the present invention.

Furthermore, strap 15 is constructed of a polypropylene material having a tensile strength in the range from 2,200 psi to 18,000 psi. However, it is to be understood that strap 15 could be manufactured using alternative types of plastics (e.g., nylon, polyethylene, thermoplastic polyurethane, thermoplastic elastomers, PA, acetal, PTFE, a combination of recycled plastic materials, such as nylon and PET, or a combination of biodegradable materials, such as polyhydroxyalkanoate (PHA), polyhydroxybutyrate (PHB) and polylactic acid (PLA)) with a similar tensile strength range without departing from the spirit of the present invention.

Strap Design Enhancements to Minimize Insert-Mold Failure

It has been found that certain plastics do not adhere particularly well together through insert-molding. In particular, it has been found that the adherence between planar surfaces of certain plastics joined together through insert-molding can often be pulled apart using minimal separation forces. Accordingly, as noted briefly above, cable tie 11 relies upon multiple mechanical interlocking elements in strap 15 to increase the surface area of the region of bonding between the two members and, as such, enhance the strength of mechanical bonding achieved by front portion 13 around connective segment 15-1 of strap 15.

For example, teeth 49 on strap 15 serve as mechanical interlocking elements that enhance the strength of mechanical bonding achieved by front portion 13 around connective segment 15-1 of strap. As seen most clearly in FIG. 4, a portion of the plastic material used to form neck 19 fills in between teeth 49 of connective segment 15-1. In this capacity, teeth 49 serve as embedded anchors in front portion 13 that substantially increase the degree of force required to pull strap 15 apart from front portion 13, which is highly desirable.

Figure 5:
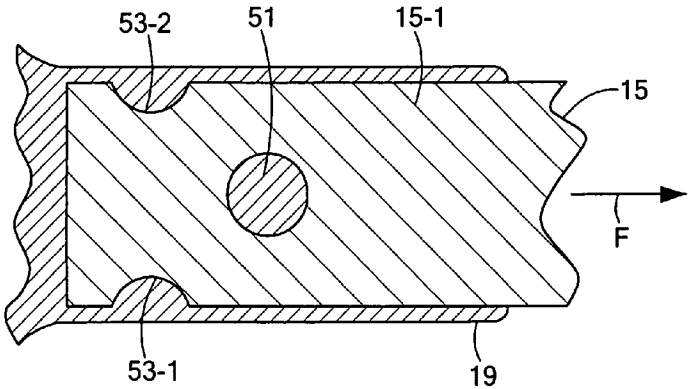
FIG. 5 is an enlarged, fragmentary section view of the cable tie of FIG. 4 taken along line 5-5.

As another example, hole 51 serves as a mechanical interlocking element that enhances the strength of mechanical bonding achieved by front portion 13 around connective segment 15-1 of strap. As seen most clearly in FIGS. 4 and 5, a portion of the plastic material used to form neck 19 fills in hole 51 and, as such, serves as a vertically-extending, cylindrical anchor through strap 15. As a result, the degree of force required to pull strap 15 apart from front portion 13, as represented by arrow F in FIG. 5, is substantially increased, which is highly desirable.

As yet another example, each semi-circular cutout 53 serves as a mechanical interlocking element that enhances the strength of mechanical bonding achieved by front portion 13 around connective segment 15-1 of strap. As seen most clearly in FIG. 5, a portion of the plastic material used to form neck 19 fills in each cutout 53 and, as such, serves as a vertically-extending, semi-cylindrical anchor through strap 15. As a result, the degree of force required to pull strap 15 apart from front portion 13, as represented by arrow F in FIG. 5, is substantially increased, which is highly desirable.

It should be noted that any narrowing of the width of strap 15 within connective segment 15-1 from front end 41 towards rear end 43 causes the plastic material used to form neck 19 to act as a vertically-extending anchor through strap 15 that precludes separation of strap 15 from front portion 13, which is highly desirable. Stated another way, any irregularity formed into side members 48 that results in a narrowing of the width of connective segment 15-1 at some point along its length (in the direction from front end 41 to rear end 43) achieves an anchoring effect. Accordingly, it is to be understood that the shape, location and number of cutouts 53 could be modified without departing from the spirit of the present invention, as will be described further in detail below.

It should also be noted that hole 51 and cutouts 53 are arranged along connective portion 15-1 of strap in an offset relationship. Specifically, hole 51 is spaced further in from front end 41 of strap 15 than cutouts 53. By offsetting the location of hole 51 and cutouts 53 along connective portion 15-1, the transverse cross-sectional area of strap 15 is maximized along the entirety of its length, thereby optimizing the strength of strap 15.

As seen most clearly in FIG. 3(*a*), the transverse cross-sectional area of strap 15 taken through line A-A represents its maximum value and can be calculated by multiplying together the width of strap 15 by the thickness of strap 15.

To the contrary, the transverse cross-sectional area of strap 15 taken along line B-B is less than the transverse cross-sectional area of strap 15 taken through line A-A due to the absence of plastic material within hole 51. Specifically, the transverse cross-sectional area of strap 15 taken through line B-B can be calculated by subtracting the maximum transverse cross-sectional area of strap 15 (i.e., the calculated value through line A-A) by the transverse cross-sectional area of hole 51 (i.e., the width of hole 51 multiplied by the thickness of strap 15). As a result of this reduction in material, it has been found that strap 15 is substantially weaker through line B-B than through line A-A.

In a similar manner, the transverse cross-sectional area of strap 15 taken through line C-C can be calculated by subtracting the maximum transverse cross-sectional area of strap 15 (i.e., the calculated value through line A-A) by the amount of plastic material removed as a result of the inclusion of cutouts 53. Because of this reduction in cross-sectional area, it has also been found that strap 15 is substantially weaker through line C-C than through line A-A.

However, it is important to note that hole 51 is longitudinally offset from cutouts 53 to maximize the cross-sectional area of strap 15 through connective portion 15-1. Otherwise, aligning hole 51 longitudinally between cutouts 53 would result in a further reduction in the transverse cross-sectional area of strap 15 therethrough, this substantial reduction in material creating a line of weakness through strap 15 that would be highly susceptible to breakage in use, which is highly undesirable.

Preferably, the transverse cross-sectional area of connective segment 15-1 of strap 15 is reduced by no more than 40% of its maximum value along the entirety of its length as a result of the inclusion of mechanical interlocking elements. By reducing the transverse cross-sectional area of connective segment 15-1 by no more than 40% of its maximum value, the strength and integrity of strap 15 is adequately maintained.

Modified Strap Designs

It is to be understood that connective segment 15-1 of strap 15 is not limited to the particular design of mechanical interlocking elements shown herein. Rather, it is to be understood that connective portion 15-1 of strap 15 could be modified to include either (i) an alternate number, (ii) an alternate shape/style, and/or (iii) an alternative arrangement of mechanical interlocking elements without departing from the spirit of the present invention. Accordingly, a series of modified, or replacement, strap designs are set forth in detail below.

Figure 6:
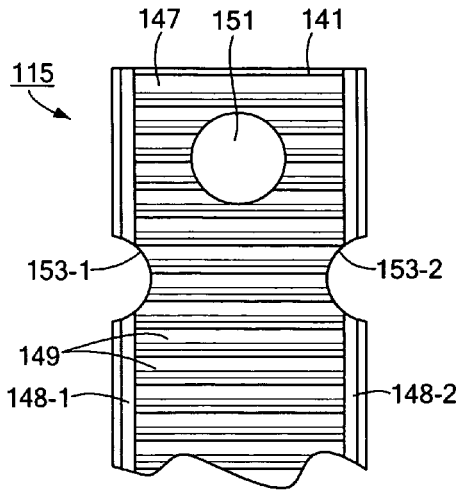
FIG. 6 is an enlarged, fragmentary, bottom plan view of a first modification to the strap shown in FIG. 3(*b*)

Referring now to FIG. 6, there is shown a fragmentary, bottom plan view of a first modified version of connective segment 15-1 of strap 15, the modified strap being identified herein simply by reference numeral 115. As can be seen, strap 115 is similar to strap 15 in that strap 115 comprises a front end 141, a rear end (not shown), a top surface (not shown), a bottom surface 147, a pair of longitudinally extending side members, or rails, 148-1 and 148-2 and a plurality of teeth 149 formed along the length of bottom surface 147, each tooth 149 extending laterally across bottom surface 147 between side members 148.

Strap 115 is also similar to strap 15 in that strap 115 is shaped to define a transverse circular hole 151 centered evenly between side members 148-1 and 148-2 and a pair of semi-circular cutouts 153-1 and 153-2 formed into side members 148-1 and 148-2, respectively. However, strap 115 differs from strap 15 in the relative positioning of hole 151 and cutouts 153 along the length of connective segment 115-1; namely, hole 151 is located closer to front end 141 than cutouts 153 (which is the opposite arrangement to strap 15).

Figure 7:
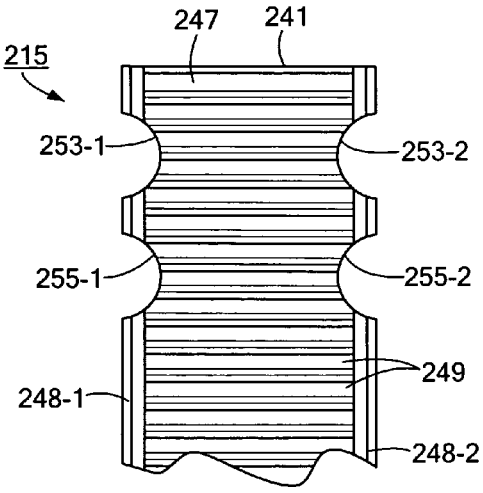
FIG. 7 is an enlarged, fragmentary, bottom plan view of another modification to the strap shown in FIG. 3(*b*)

Referring now to FIG. 7, there is shown a fragmentary, bottom plan view of another modified version of connective segment 15-1 of strap 15, the modified strap being identified herein simply by reference numeral 215. As can be seen, strap 215 is similar to strap 15 in that strap 215 comprises a front end 241, a rear end (not shown), a top surface (not shown), a bottom surface 247, a pair of longitudinally extending side members, or rails, 248-1 and 248-2 and a plurality of teeth 249 formed along the length of bottom surface 247, each tooth 249 extending laterally across bottom surface 247 between side members 248.

Strap 215 is also similar to strap 15 in that strap 215 is shaped to include a first pair of opposing, semi-circular cutouts 253-1 and 253-2 that are formed into side members 248-1 and 248-2, respectively. However, strap 215 differs from strap 15 in that, rather than being shaped to include a centrally located circular hole, strap 215 is alternatively shaped to include a second pair of opposing, semi-circular cutouts 255-1 and 255-2 that are similarly formed into side members 248-1 and 248-2, respectively, with first pair of cutouts 253 being spaced slightly apart from second pair of cutouts 255.

Figure 8:
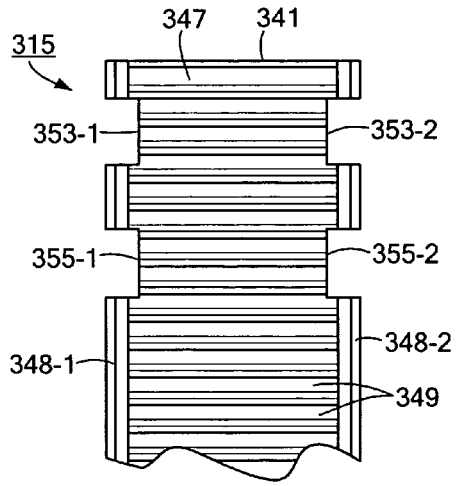
FIG. 8 is an enlarged, fragmentary, bottom plan view of another modification to the strap shown in FIG. 3(*b*)

Referring now to FIG. 8, there is shown a fragmentary, bottom plan view of another modified version of connective segment 15-1 of strap 15, the modified strap being identified herein simply by reference numeral 315. As can be seen, strap 315 is similar to strap 215 in that strap 315 comprises a front end 341, a rear end (not shown), a top surface (not shown), a bottom surface 347, a pair of longitudinally extending side members, or rails, 348-1 and 348-2 and a plurality of teeth 349 formed along the length of bottom surface 347, each tooth 349 extending laterally across bottom surface 347 between side members 348.

Strap 315 is also similar to strap 215 in that strap 315 is shaped to include a first pair of opposing cutouts 353-1 and 353-2 that are formed into side members 348-1 and 348-2, respectively, and a second pair of opposing cutouts 355-1 and 355-2 that are formed into side members 348-1 and 348-2, respectively. However, strap 315 differs from strap 215 in that the shape of each of cutouts 353 and 355 is generally rectangular in transverse cross-section rather than semi-circular.

Figure 9:
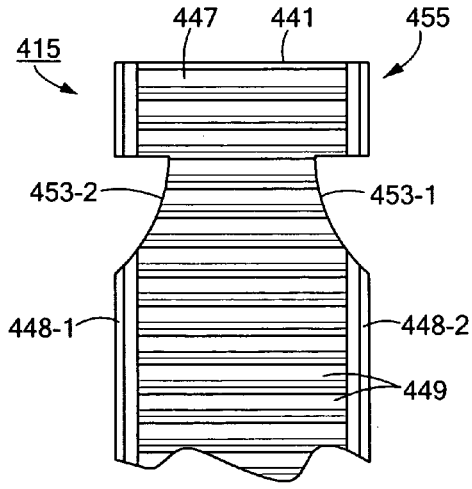
FIG. 9 is an enlarged, fragmentary, bottom plan view of another modification to the strap shown in FIG. 3(*b*)

Referring now to FIG. 9, there is shown a fragmentary, bottom plan view of another modified version of connective segment 15-1 of strap 15, the modified strap being identified herein simply by reference numeral 415. As can be seen, strap 415 is similar to strap 15 in that strap 415 comprises a front end 441, a rear end (not shown), a top surface (not shown), a bottom surface 447, a pair of longitudinally extending side members, or rails, 448-1 and 448-2 and a plurality of teeth 449 formed along the length of bottom surface 447, each tooth 449 extending laterally across bottom surface 447 between side members 448.

Strap 415 is also similar to strap 15 in that strap 415 is shaped to include a pair of opposing cutouts 453-1 and 453-2 that are formed into side members 448-1 and 448-2, respectively. However, strap 415 differs from strap 15 in that strap 415 is not shaped to include a circular hole. In addition, strap 415 differs from strap 15 in that the shape of each cutout 453 is generally fin-shaped, or quarter-elliptical, in transverse cross-section. As can be appreciated, the fin-shaped design of cutouts 453 creates a hammerhead-style, rectangular anchor 455 at front end 441 that enhances the quality of the mechanical bonding strength established between front portion 13 and strap 415, which is highly desirable.

Figure 10:
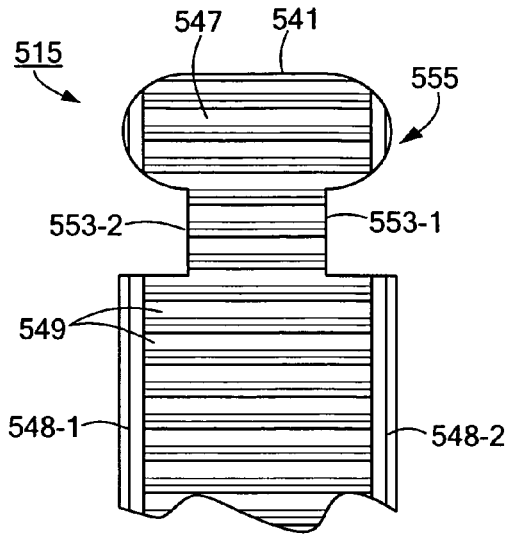
FIG. 10 is an enlarged, fragmentary, bottom plan view of another modification to the strap shown in FIG. 3(*b*)

Referring now to FIG. 10, there is shown a fragmentary, bottom plan view of another modified version of connective segment 15-1 of strap 15, the modified strap being identified herein simply by reference numeral 515. As can be seen, strap 515 is similar to strap 415 in that strap 515 comprises a front end 541, a rear end (not shown), a top surface (not shown), a bottom surface 547, a pair of longitudinally extending side members, or rails, 548-1 and 548-2 and a plurality of teeth 549 formed along the length of bottom surface 547, each tooth 549 extending laterally across bottom surface 547 between side members 548.

Strap 515 is also similar to strap 415 in that strap 515 is shaped to include a pair of opposing cutouts 553-1 and 553-2 that are formed into side members 548-1 and 548-2, respectively. However, strap 515 differs from strap 415 in that the shape of each cutout 553 is generally rectangular in transverse cross-section. In addition, the portion of side members 548 situated between front end 541 and cutouts 553 is rounded which, in turn, creates an elliptical anchor 555 at front end 541 that enhances the quality of the mechanical bonding strength established between front portion 13 and strap 515, which is highly desirable.

Figure 11:
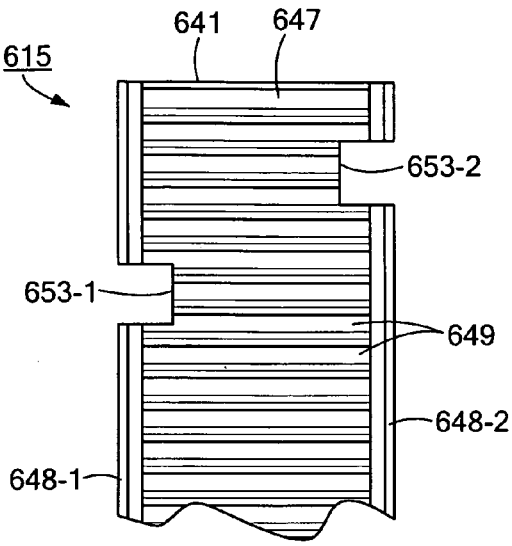
FIG. 11 is an enlarged, fragmentary, bottom plan view of another modification to the strap shown in FIG. 3(*b*)

Referring now to FIG. 11, there is shown a fragmentary, bottom plan view of another modified version of connective segment 15-1 of strap 15, the modified strap being identified herein simply by reference numeral 615. As can be seen, strap 615 is similar to strap 315 in that strap 615 comprises a front end 641, a rear end (not shown), a top surface (not shown), a bottom surface 647, a pair of longitudinally extending side members, or rails, 648-1 and 648-2 and a plurality of teeth 649 formed along the length of bottom surface 647, each tooth 649 extending laterally across bottom surface 647 between side members 648.

Strap 615 is also similar to strap 315 in that strap 615 is shaped to include a pair of opposing, rectangular cutouts 653-1 and 653-2 that are formed into side members 648-1 and 648-2, respectively. However, strap 615 differs from strap 315 in that strap 615 is not shaped to include a second pair of opposing, rectangular cutouts. In addition, strap 615 differs from strap 315 in that cutouts 653-1 and 653-2 are arranged in an offset relationship relative to one another along the length of strap 615. As can be appreciated, by offsetting cutouts 653, the transverse cross-sectional area of strap 615 is maximized along its length, thereby increasing the strength of strap 615, which is highly desirable.

Figure 12:
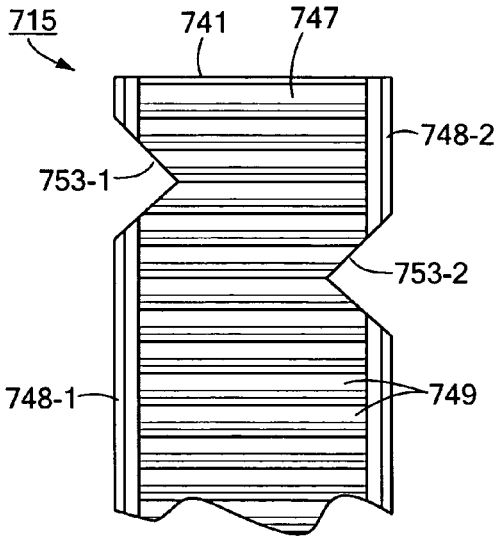
FIG. 12 is an enlarged, fragmentary, bottom plan view of another modification to the strap shown in FIG. 3(*b*)

Referring now to FIG. 12, there is shown a fragmentary, bottom plan view of another modified version of connective segment 15-1 of strap 15, the modified strap being identified herein simply by reference numeral 715. As can be seen, strap 715 is similar to strap 615 in that strap 715 comprises a front end 741, a rear end (not shown), a top surface (not shown), a bottom surface 747, a pair of longitudinally extending side members, or rails, 748-1 and 748-2 and a plurality of teeth 749 formed along the length of bottom surface 747, each tooth 749 extending laterally across bottom surface 747 between side members 748.

Strap 715 is also similar to strap 615 in that strap 715 is shaped to include a pair of opposing cutouts 753-1 and 753-2 that are formed into side members 748-1 and 748-2, respectively. However, strap 715 differs from strap 615 in that (i) cutouts 753 are triangular in transverse cross-section rather than rectangular in transverse cross-section and (ii) cutouts 753 are offset from one another in the opposite manner than cutouts 653 (i.e., with cutout 753-1 located closer to front end 741 than cutout 753-2).

Figure 13:
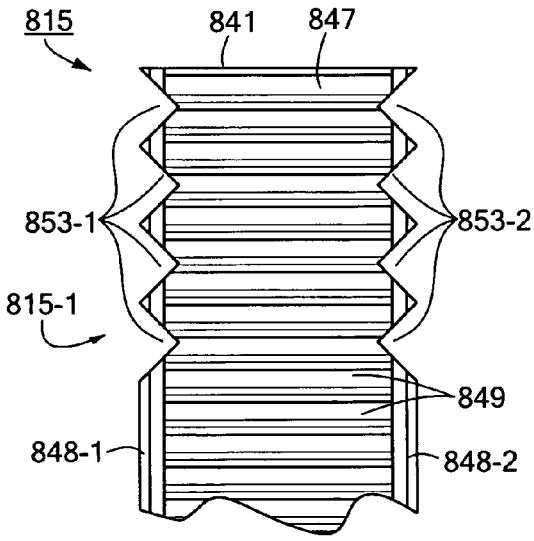
FIG. 13 is an enlarged, fragmentary, bottom plan view of another modification to the strap shown in FIG. 3(*b*)

Referring now to FIG. 13, there is shown a fragmentary, bottom plan view of another modified version of connective segment 15-1 of strap 15, the modified strap being identified herein simply by reference numeral 815. As can be seen, strap 815 is similar to strap 715 in that strap 815 comprises a front end 841, a rear end (not shown), a top surface (not shown), a bottom surface 847, a pair of longitudinally extending side members, or rails, 848-1 and 848-2 and a plurality of teeth 849 formed along the length of bottom surface 847, each tooth 849 extending laterally across bottom surface 847 between side members 848.

Strap 815 differs from strap 715 in that strap 815 comprises a first set of continuously connected cutouts 853-1 formed into side member 848-1 along the majority of the length of connective segment 815-1 and a second set of continuously connected cutouts 853-2 formed into side member 848-2 along the majority of the length of connective segment 815-1. As can be seen, each individual cutout 853 is in the shape of an isosceles triangle which, in turn, provides side members 848 with a sawtooth-style design within connective segment

815-1, the sawtooth design significantly increasing the mechanical bonding strength established between front portion 13 and strap 815, which is highly desirable.

Figure 14:
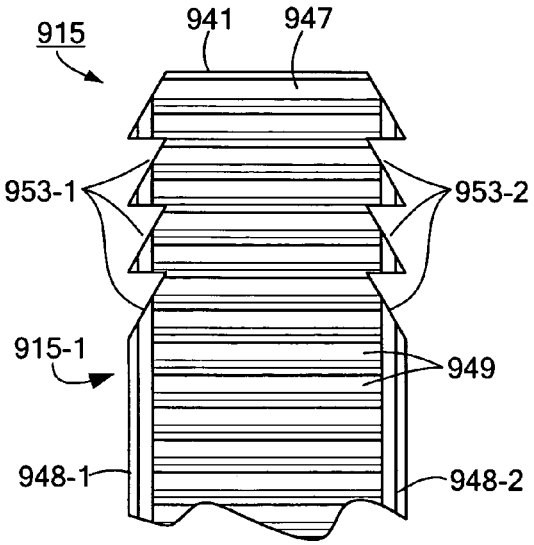
FIG. 14 is an enlarged, fragmentary, bottom plan view of another modification to the strap shown in FIG. 3(*b*)

Referring now to FIG. 14, there is shown a fragmentary, bottom plan view of another modified version of connective segment 15-1 of strap 15, the modified strap being identified herein simply by reference numeral 915. As can be seen, strap 915 is similar to strap 815 in that strap 915 comprises a front end 941, a rear end (not shown), a top surface (not shown), a bottom surface 947, a pair of longitudinally extending side members, or rails, 948-1 and 948-2 and a plurality of teeth 949 formed along the length of bottom surface 947, each tooth 949 extending laterally across bottom surface 847 between side members 848.

Strap 915 is also similar to strap 815 in that strap 915 comprises a first set of continuously connected cutouts 953-1 formed into side member 948-1 along the majority of the length of connective segment 915-1 and a second set of continuously connected cutouts 953-2 formed into side member 948-2 along the majority of the length of connective segment 915-1. Strap 915 differs from strap 815 in that, among other things, each individual cutout 953 is in the shape of a right triangle which, in turn, provides side members 948 with a ratchet-style design within connective segment 915-1, the ratchet-style design significantly increasing the mechanical bonding strength established between front portion 13 and strap 915, which is highly desirable.

Figure 15:
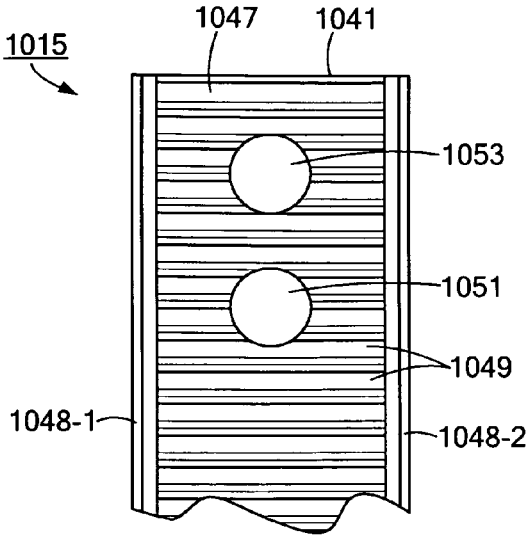
FIG. 15 is an enlarged, fragmentary, bottom plan view of another modification to the strap shown in FIG. 3(*b*)

Referring now to FIG. 15, there is shown a fragmentary, bottom plan view of another modified version of connective segment 15-1 of strap 15, the modified strap being identified herein simply by reference numeral 1015. As can be seen, strap 1015 is similar to strap 15 in that strap 1015 comprises a front end 1041, a rear end (not shown), a top surface (not shown), a bottom surface 1047, a pair of longitudinally extending side members, or rails, 1048-1 and 1048-2 and a plurality of teeth 1049 formed along the length of bottom surface 1047, each tooth 1049 extending laterally across bottom surface 1047 between side members 1048.

Strap 1015 is also similar to strap 15 in that strap 1015 is shaped to include a first hole 1051 located centrally between side members 1048-1 and 1048-2. However, strap 1015 differs from strap 15 in that, rather than being shaped to include a pair of semi-circular cutouts, strap 1015 is alternatively shaped to include a second hole 1053 located centrally between side members 1048-1 and 1048-2, with first hole 1051 and second hole 1053 arranged longitudinally along the length of strap 1015 in a spaced apart relationship. As can be appreciated, the inclusion of secondary hole 1053 renders the mechanical bonding strength established between front portion 13 and strap 1015 significantly greater than if strap 1015 included only hole 1051.

Figure 16:
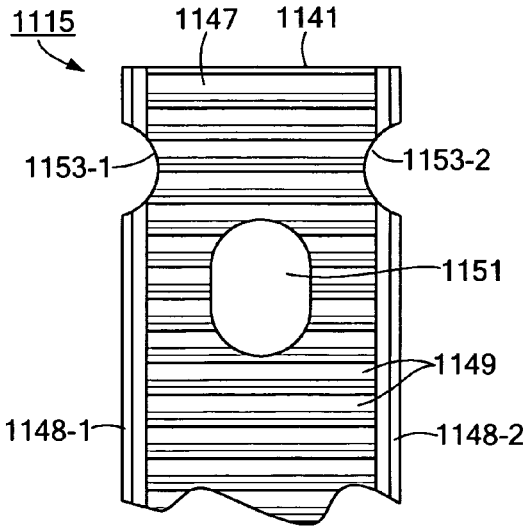
FIG. 16 is an enlarged, fragmentary, bottom plan view of another modification to the strap shown in FIG. 3(*b*)

Referring now to FIG. 16, there is shown a fragmentary, bottom plan view of another modified version of connective segment 15-1 of strap 15, the modified strap being identified herein simply by reference numeral 1115. As can be seen, strap 1115 is similar to strap 15 in that strap 1115 comprises a front end 1141, a rear end (not shown), a top surface (not shown), a bottom surface 1147, a pair of longitudinally extending side members, or rails, 1148-1 and 1148-2 and a plurality of teeth 1149 formed along the length of bottom surface 1147, each tooth 1149 extending laterally across bottom surface 1147 between side members 1148.

Strap 1115 is also similar to strap 15 in that strap 1115 is shaped to define a transverse hole 1151 centered evenly between side members 1148-1 and 1148-2 and a pair of semi-circular cutouts 1153-1 and 1153-2 that are formed into side members 1148-1 and 1148-2, respectively. However, strap 1115 differs from strap 15 in that hole 1151 has an elliptical shape in transverse cross-section rather than circular, the lengthening of hole 1151 increasing the amount of material from front portion 13 that passes therethrough, thereby increasing the mechanical bonding strength established between front portion 13 and strap 1115, which is highly desirable.

Figure 17:
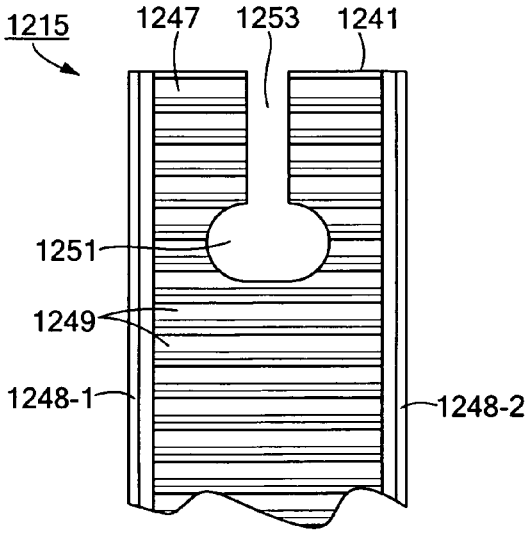
FIG. 17 is an enlarged, fragmentary, bottom plan view of another modification to the strap shown in FIG. 3(*b*)

Referring now to FIG. 17, there is shown a fragmentary, bottom plan view of another modified version of connective segment 15-1 of strap 15, the modified strap being identified herein simply by reference numeral 1215. As can be seen, strap 1215 is similar to strap 1115 in that strap 1215 comprises a front end 1241, a rear end (not shown), a top surface (not shown), a bottom surface 1247, a pair of longitudinally extending side members, or rails, 1248-1 and 1248-2 and a plurality of teeth 1249 formed along the length of bottom surface 1247, each tooth 1249 extending laterally across bottom surface 1247 between side members 1248.

Strap 1215 is also similar to strap 1115 in that strap 1215 is shaped to define an elliptical hole 1251 centered evenly between side members 1248-1 and 1248-2. However, strap 1215 differs from strap 1115 in that strap 1215 does not additionally include a pair of semi-circular notches. Furthermore, a narrow longitudinal channel, or opening, 1253 extends rearwardly from front end 1241 to elliptical hole 1215 in place of cutouts.

Figure 18A:
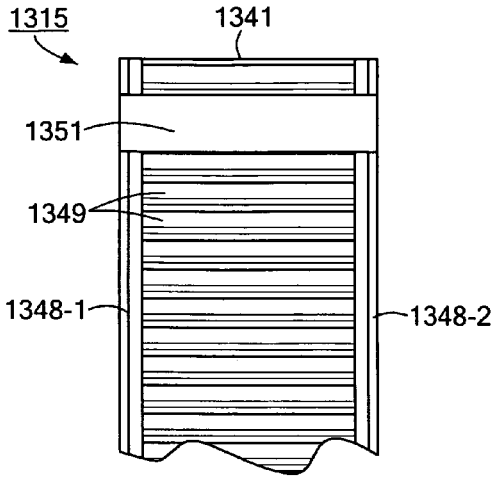
FIGS. 18(*a*) and 18(*b*) are enlarged, fragmentary, bottom plan and left side views, respectively, of another modification to the strap shown in FIG. 3(*b*)
Figure 18B:
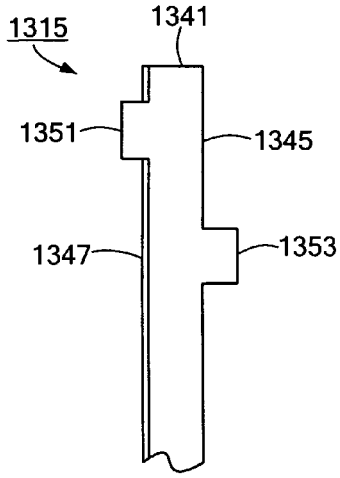

Referring now to FIGS. 18(*a*) and 18(*b*), there are shown fragmentary, bottom plan and left side views of another modified version of connective segment 15-1 of strap 15, the modified strap being identified herein simply by reference numeral 1315. As can be seen, strap 1315 is similar to strap 15 in that strap 1315 comprises a front end 1341, a rear end (not shown), a top surface 1345, a bottom surface 1347, a pair of longitudinally extending side members, or rails, 1348-1 and 1348-2 and a plurality of teeth 1349 formed along the length of bottom surface 1347, each tooth 1349 extending laterally across bottom surface 1347 between side members 1348.

Strap 1315 differs from strap 15 in that strap 1315 relies on surface projections, rather than cutouts and/or holes, to enhance the strength of mechanical bonding established between front portion 13 and strap 1315. Specifically, strap 1315 comprises a first projection 1351, rectangular in transverse cross-section, that is integrally formed onto and projects orthogonally out from bottom surface 1347, projection 1351 extending laterally across the entire width of strap 1351. Similarly, strap 1315 comprises a second projection 1353, rectangular in transverse cross-section, that is integrally formed onto and projects orthogonally out from top surface 1345, projection 1353 extending laterally across the entire width of strap 1351. As seen most clearly in FIG. 18(*b*), projections 1351 and 1353 are offset from one another longitudinally along the length of strap 1315.

Figure 19A:
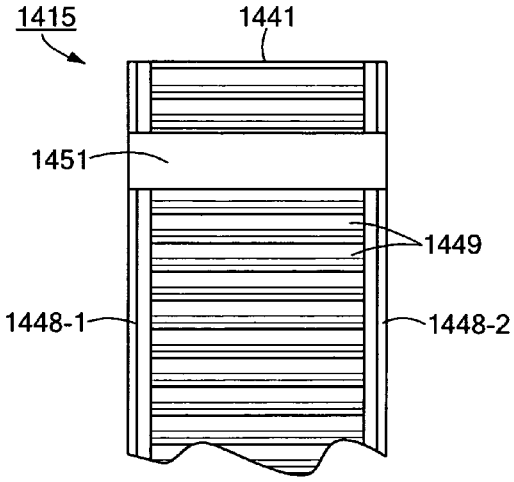
FIGS. 19(*a*) and 19(*b*) are enlarged, fragmentary, bottom plan and left side views, respectively, of another modification to the strap shown in FIG. 3(*b*)
Figure 19B:
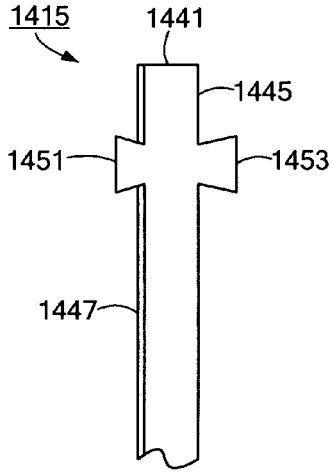

Referring now to FIGS. 19(*a*) and 19(*b*), there are shown fragmentary, bottom plan and left side views of another modified version of connective segment 15-1 of strap 15, the modified strap being identified herein simply by reference numeral 1415. As can be seen, strap 1415 is similar to strap 1315 in that strap 1415 comprises a front end 1441, a rear end (not shown), a top surface 1445, a bottom surface 1447, a pair of longitudinally extending side members, or rails, 1448-1 and 1448-2 and a plurality of teeth 1449 formed along the length of bottom surface 1447, each tooth 1449 extending laterally across bottom surface 1447 between side members 1448.

Strap 1415 is similar to strap 1315 in that strap 1415 comprises a first projection 1451, rectangular in transverse cross-section, that is integrally formed onto and projects orthogonally out from bottom surface 1447, projection 1451 extending laterally across the entire width of strap 1451. Similarly, strap 1415 comprises a second projection 1453, rectangular in transverse cross-section, that is integrally formed onto and projects orthogonally out from top surface 1445, projection 1453 extending laterally across the entire width of strap 1451. As seen most clearly in FIG. 18(*b*), strap 1415 differs from strap 1315 in that projections 1451 and 1453 are (i) in alignment with one another longitudinally along the length of strap 1415 and (ii) are generally dovetailed in transverse cross-section.

Additional Cable Tie Constructions

In addition to the alternative strap designs set forth above, additional modifications could be made to cable tie 11 without departing from the spirit of the present invention. In particular, it is to be understood that the particular method for constructing cable tie 11 could be modified without departing from the spirit of the present invention.

Figures 20A, 20B, 20C:
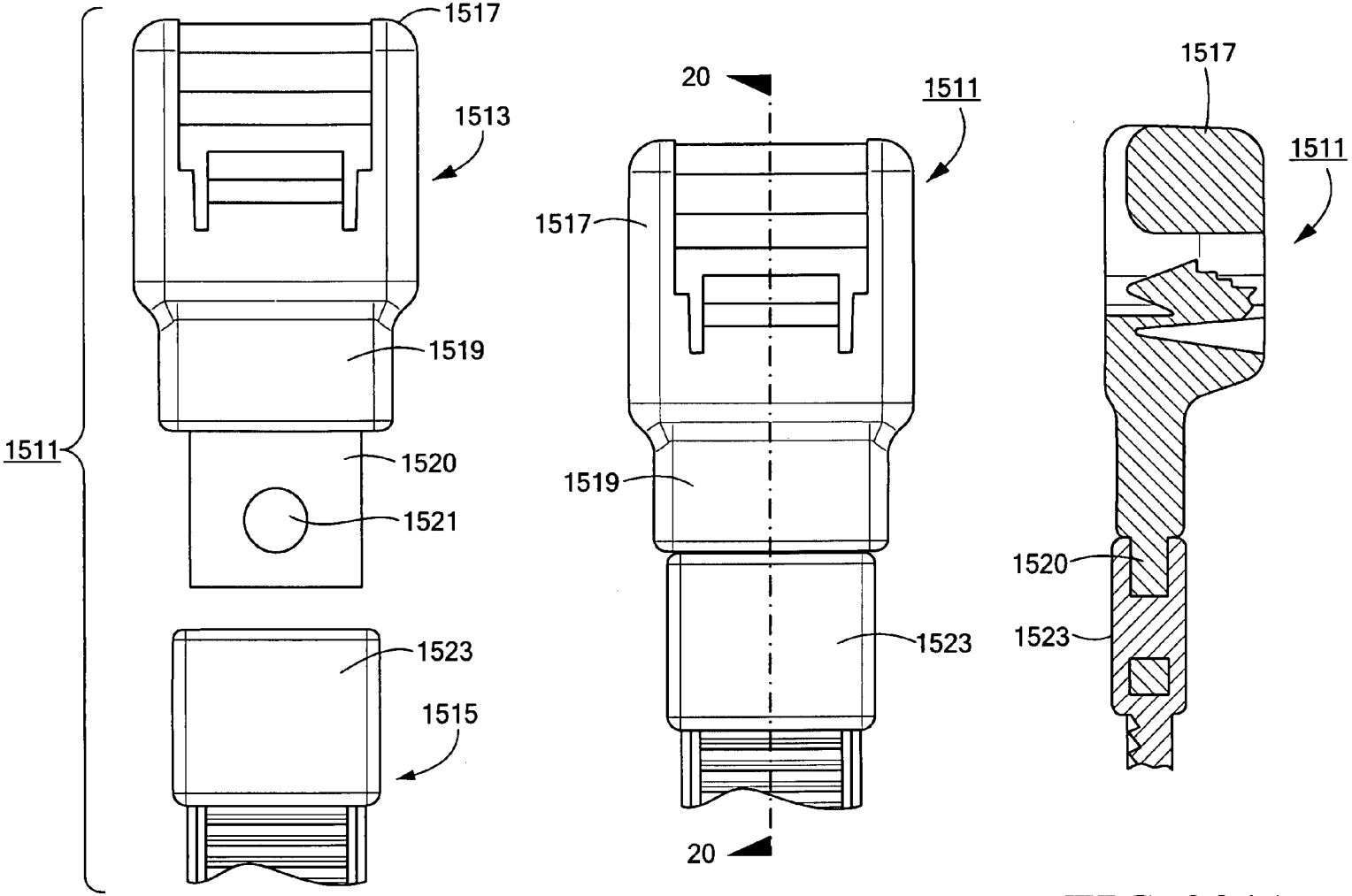
FIG. 20(*a*) is a fragmentary, exploded, top plan view of another embodiment of a two-piece cable tie constructed according to the teachings of the present invention.

Specifically, referring now to FIGS. 20(*a*) thru 20(*c*), there are shown various views of another embodiment of a two-piece cable tie constructed according to the teachings of the present invention, the cable tie being identified generally by reference numeral 1511. Cable tie 1511 is similar to cable tie 11 in that cable tie 1511 comprises a front portion 1513 and a strap 1515 that are preferably formed through separate molding processes. Cable tie 1511 differs from tie 11 in that strap 1515 is insert molded onto one end of front portion 1513 (i.e., instead of front portion 1513 being insert molded onto strap 1515).

As seen most clearly in FIG. 20(*a*), front portion 1513 comprises a head 1517, a neck 1519 extending rearwardly from head 1517 and a thin, square tab 1520 extending rearwardly from neck 1519. Tab 1520 is shaped to include a circular hole 1521 that functions similarly to the various styles of mechanical interlocking elements described in detail above.

Strap 1515 is similar to strap 15 in that strap 1515 is constructed as an elongated, generally rectangular strip that is highly flexible in nature. Strap 1515 differs from strap 15 in that strap 1515 comprises an enlarged buckle 1523 at one end. As part of manufacturing process for cable tie 1515, buckle 1523 of strap 1515 is insert molded around tab 1520 which, in turn, serves to permanently join together front portion 1513 and strap 1515, as seen most clearly in FIGS. 20(*b*) and 20(*c*).

Even though all of the two-piece cable ties described in detail above utilize the process of insert-molding to couple together each front end with its corresponding strap, it is to be understood that alternative means for coupling the front end of a two-piece cable tie with its associated strap could be utilized without departing from the spirit of the present invention. Specifically, referring now to FIGS. 21(*a*) thru 21(*c*), there shown various views of another embodiment of a two-piece cable tie constructed according to the teachings of the present invention, the cable tie being identified generally by reference numeral 1611. Cable tie 1611 is similar to cable tie 11 in that cable tie 1611 comprises a front portion 1613 and a strap 1615 that are preferably formed through separate molding processes. Cable tie 1611 differs from tie 11 in that strap 1611 is coupled to front portion 1613 through a snap-mounting process (i.e., instead of an insert-molding process).

Figure 21C:
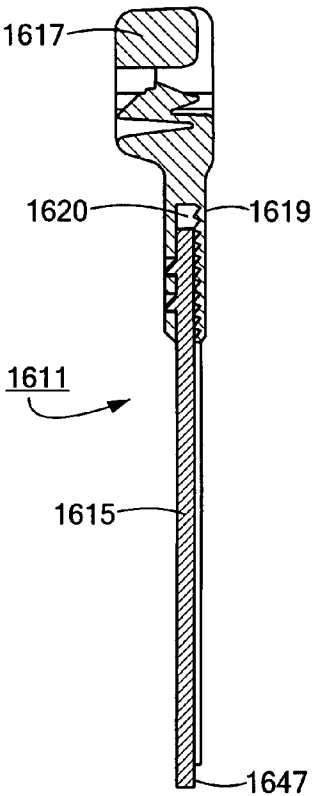
FIG. 21(*a*) is an exploded, top plan view of another embodiment of a two-piece cable tie constructed according to the teachings of the present invention.
Figure 21B:
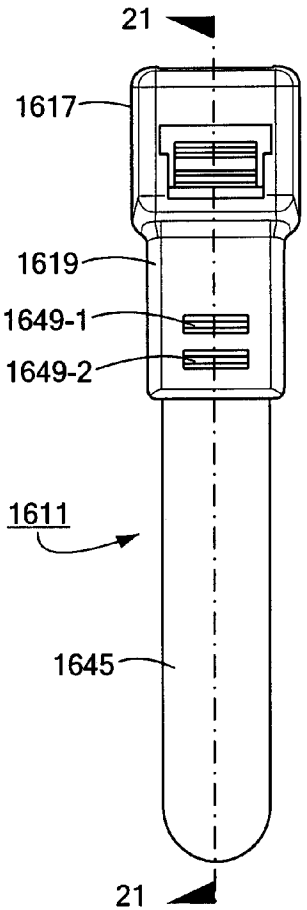
Figure 21A:
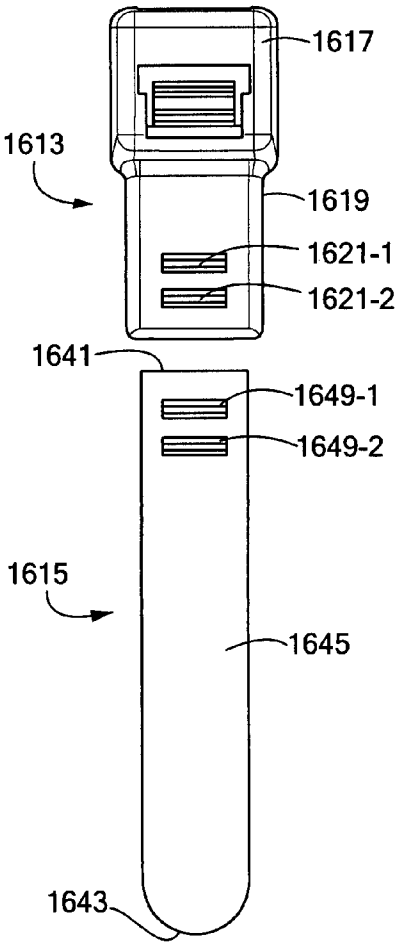

As seen most clearly in FIG. 21(*a*), front portion 1613 comprises a head 1617 and a neck 1619 extending rearwardly from head 1617. Neck 1619 is shaped to include a pair of transverse slots 1621-1 and 1621-2 in its top surface, the function of slots 1621 to become apparent below.

Strap 1615 is similar to strap 15 in that strap 1615 is constructed as an elongated, generally rectangular strip that is highly flexible in nature and includes a front end 1641, a rear end 1643, a flattened top surface 1645 and a bottom surface 1647. Strap 1615 differs from strap 15 in that strap 1615 comprises a pair of ratchet-shaped projections 1649-1 and 1649-2 that are formed on top surface 1645 at front end 1641.

As part of the manufacturing process for cable tie 1615, front end 1613 and strap 1615 are separately formed through independent molding processes (e.g., through injection molding). To join the separate pieces together, front end 1641 of strap 1615 is inserted in through an open slot 1620 formed in the rear end of neck 1619. Strap 1615 is advanced through slot 1620 in neck 1619 until projections 1649-1 and 1649-2 protrude through corresponding slots 1621-1 and 1621-2, respectively. In this manner, strap 1615 is permanently snap-connected to front end 1641 to form a unitary device.

It should also be noted that the present invention is not limited to a two-piece design. Rather, it is to be understood that the principles set forth above could be implemented in a three-piece cable tie without departing from the spirit of the present invention. Specifically, referring now to FIGS. 22(*a*) thru 22(*c*), there shown various views of a three-piece cable tie constructed according to the teachings of the present invention, the cable tie being identified generally by reference numeral 1711.

Cable tie 1711 is similar to cable tie 11 in that cable tie 1711 comprises a front portion 1713 and a strap 1715 that are separately formed through independent molding processes. Cable tie 1711 differs from tie 11 in that tie 1711 additionally comprises a connective piece 1716 that couples front portion 1713 and strap 1715 together.

Figure 22C:
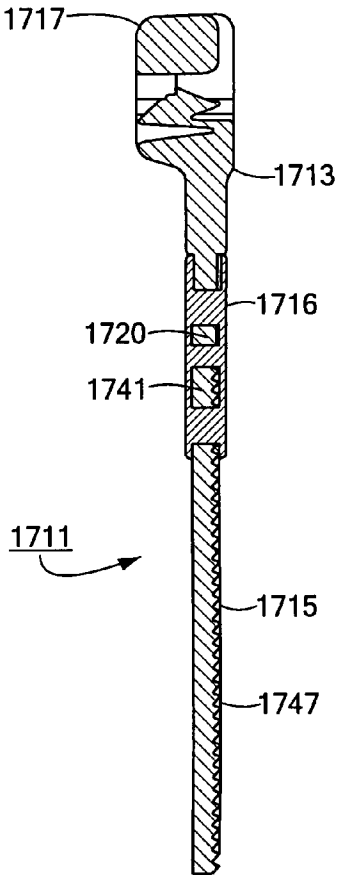
FIG. 22(*a*) is an exploded, fragmentary, top plan view of a three-piece cable tie constructed according to the teachings of the present invention.
Figure 22B:
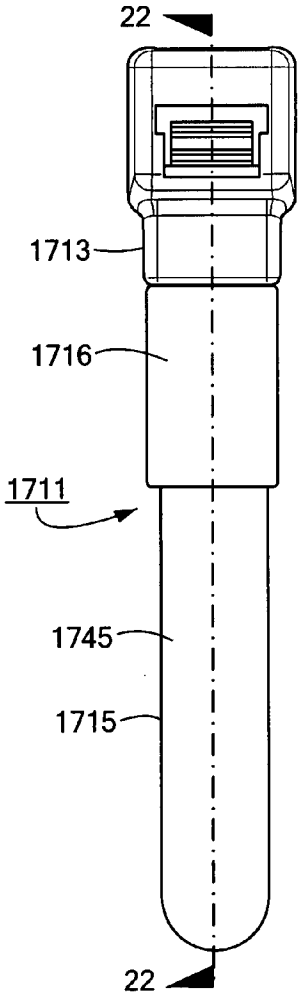
Figure 22A:
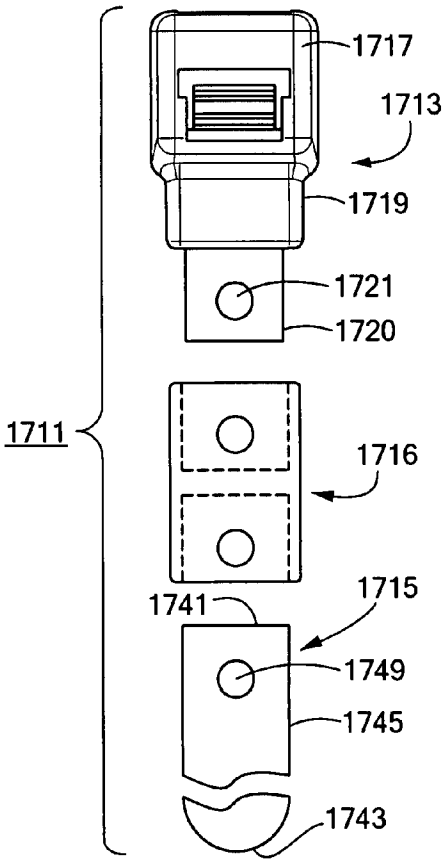

As seen most clearly in FIG. 22(*a*), front portion 1713 is similar to front portion 1513 in that front portion 1713 comprises a head 1717, a neck 1719 extending rearwardly from head 1717 and a thin, square tab 1720 extending rearwardly from neck 1719. Tab 1720 is shaped to include a circular hole 1721 that functions similarly to the various styles of mechanical interlocking elements described in detail above.

Strap 1715 is similar to strap 15 in that strap 1715 is constructed as an elongated, generally rectangular strip that is highly flexible in nature and includes a front end 1741, a rear end 1743, a flattened top surface 1745 and a bottom surface 1747. Strap 1715 is also similar to strap 15 in that strap 1715 is shaped to include a transverse circular hole 1749 at front end 1741.

As noted above, cable tie 1711 differs from cable tie 11 in that cable tie 1711 comprises a third piece 1716 for joining together front portion 1713 and strap 1715. Specifically, as part of the manufacturing process for cable tie 1715, front end 1713 and strap 1715 are separately formed through independent molding processes (e.g., through injection molding). To join the separate pieces together, connective piece 1716 is insert molded onto both tab 1720 of front portion 1713 and front end 1741 of strap 1715, as shown in FIGS. 22(*b*) and 22(*c*). As can be seen, connective piece 1716 is constructed as an enlarged rectangular buckle, with molded connective piece 1716 extending through both holes 1721 and 1749 to strengthen the mechanical interlock established between pieces.

Cable Tie Relief Feature

Further design enhancements to the cable ties described in detail above could be provided without departing from the spirit of the present invention. In particular, it is to be understood that cable tie 11 could be modified in its design to allow for increased conformity with a bundle that is generally circular in transverse cross-section, as will be described in detail below.

Figure 23A:
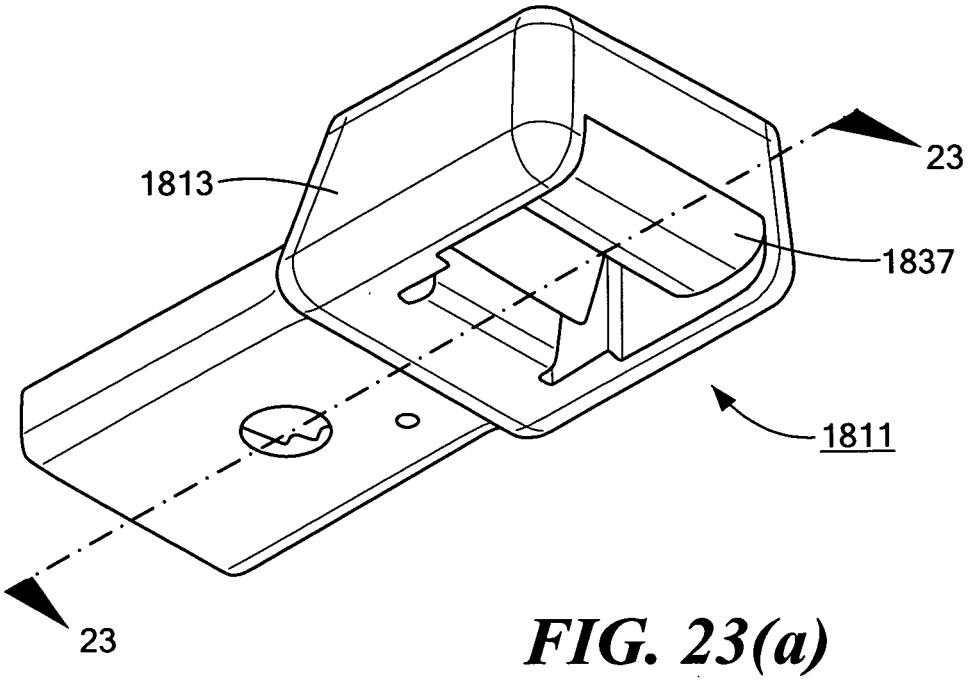
FIG. 23(*a*) is a fragmentary, bottom perspective view of another embodiment of a two-piece cable tie constructed according to the teachings of the present invention.
Figure 23B:
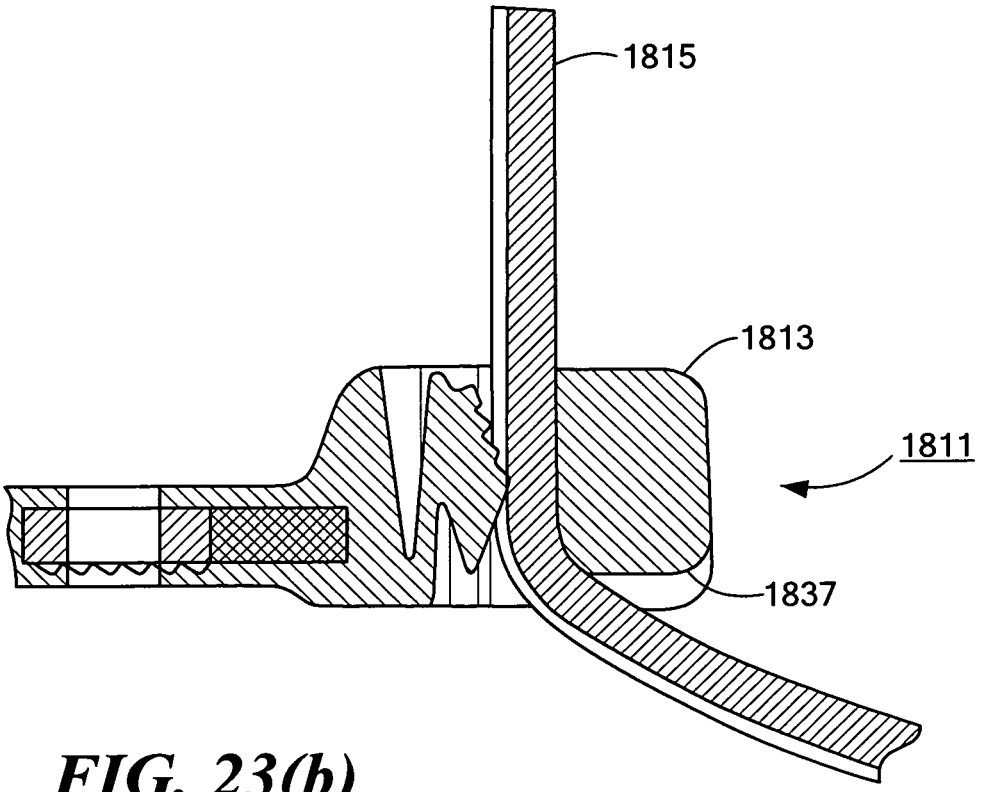
Figure 24A:
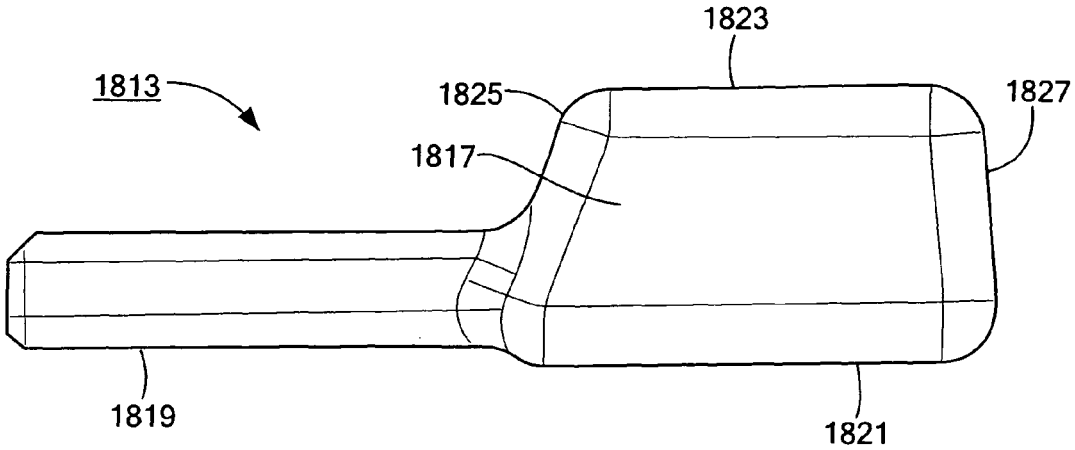
FIGS. 24(*a*)-(*c*) are front plan, right end, and top plan views, respectively, of the front portion shown in FIG. 23(*a*)
Figure 24B:
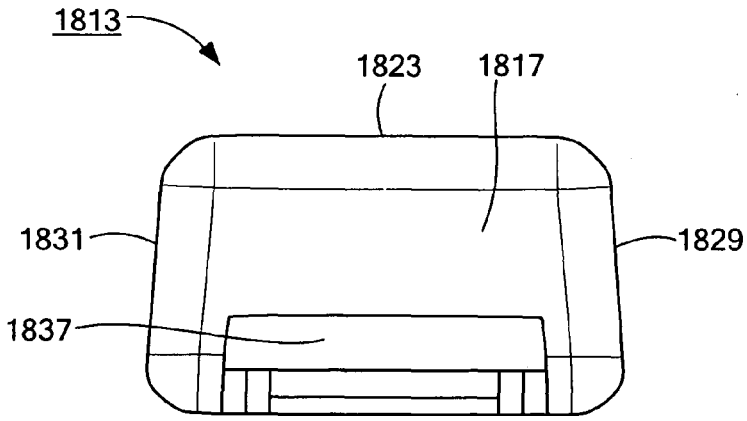
Figure 24C:
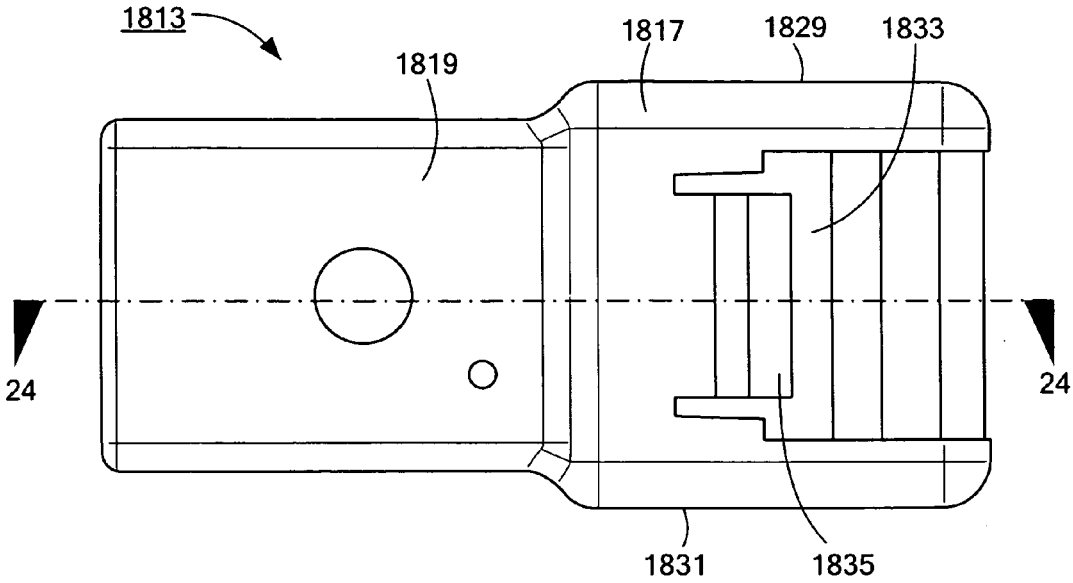
Figure 24D:
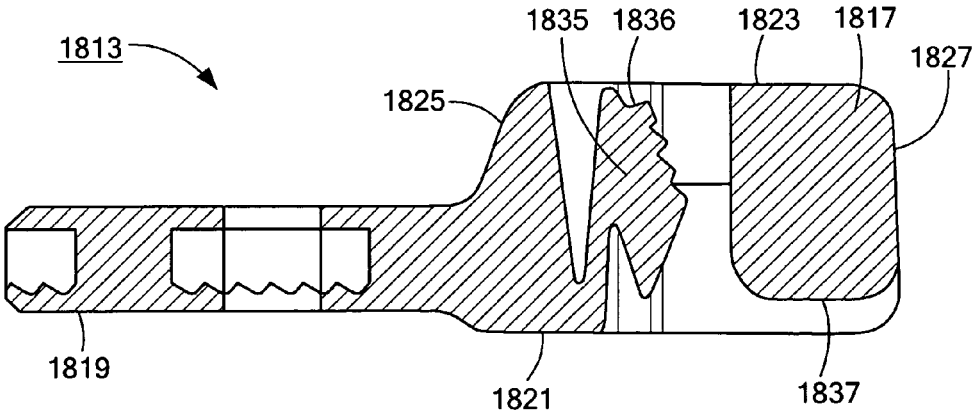

Specifically, referring now to FIGS. 23(*a*) and 23(*b*), there is shown various views of another embodiment of a two-piece cable tie constructed according to the teachings of the present invention, the cable tie being identified generally by reference numeral 1811. Cable tie 1811 is similar in construction to cable tie 11 in that cable tie 1811 comprises a front portion 1813 and an attached strap 1815 that are preferably formed through separate molding processes. Cable tie 1811 differs from tie 11 in that front portion 1813 is specifically designed to enable strap 1815 to more adequately conform against a circular bundle when cinched therearound.

Referring now to FIGS. 24(*a*)-(*d*), there are shown various views of front portion 1813. As can be seen, front portion 1813 includes an enlarged head 1817 and an outwardly extending neck 1819.

Head 1817 is similar to head 17 in that head 1817 is in the form of an enlarged, rectangular block that is shaped to include a bottom wall 1821, a top wall 1823, a front wall 1825, a rear wall 1827, a left side wall 1829, a right side wall 1831 and an elongated channel 1833 which extends through head 1817 from bottom wall 1821 to top wall 1823. Head 1817 also similarly includes a locking tang, or pawl, 1835 that extends into channel 1833, pawl 1835 being shaped to include a plurality of teeth 1836 that are adapted to lockably engage strap 1815.

Head 1817 differs primarily from head 17 in that head 1817 is shaped to include an area of relief 1837 in its bottom wall 1821. Specifically, the portion of bottom wall 1821 that extends between channel 1833 and rear wall 1827 includes an area that is slightly recessed in relation to the remainder of bottom wall 1821, the recessed area being identified herein as relief 1837. As can be appreciated, the width of relief 1837 is slightly greater than the width of strap 1815. In addition, the front and rear edges of relief 1837 are preferably rounded, as shown in FIG. 24(*d*). As a result, relief 1837 enables a segment of strap 1815 to enter into channel 1833 at an acute (i.e., more horizontally disposed) angle, which is highly desirable.

Figure 25A:
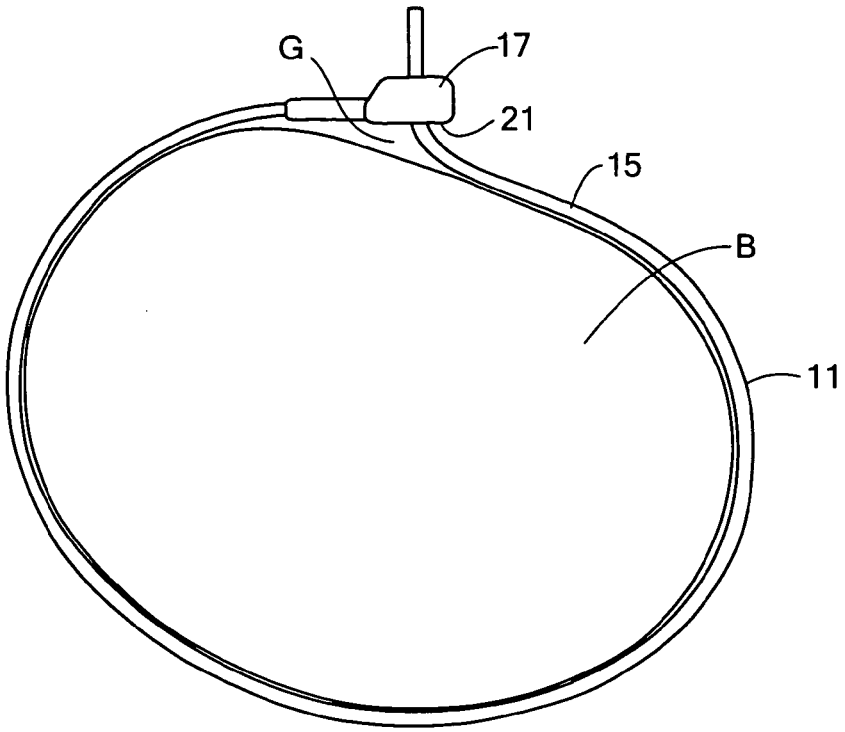
FIG. 25(*a*) is a front plan view of the cable tie of FIG. 1 shown cinched around a bundle.
Figure 25B:
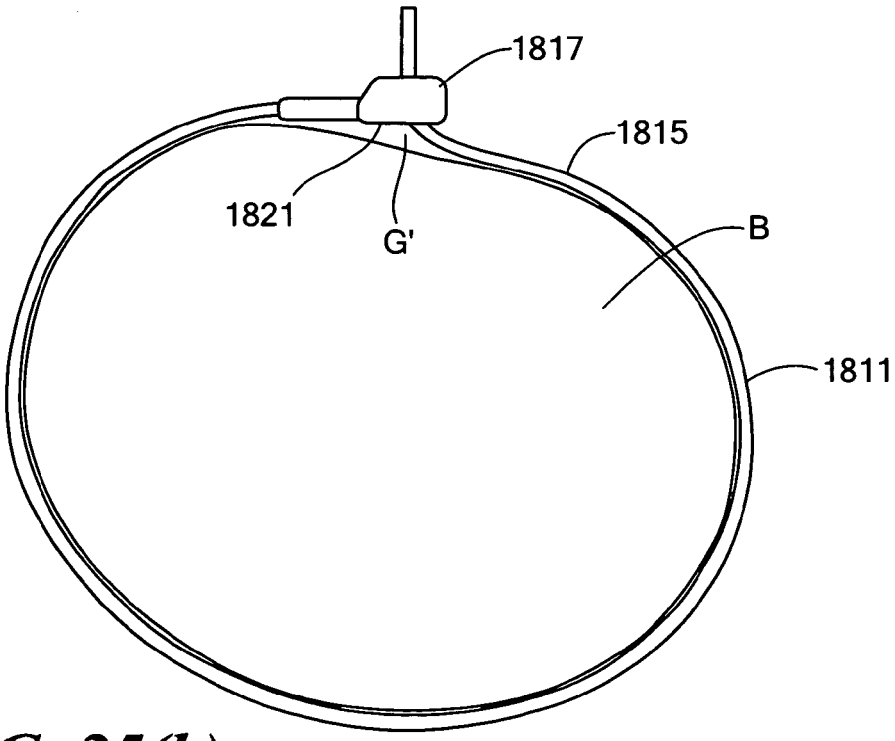

Specifically, referring now to FIGS. 25(*a*) and 25(*b*), there is shown a side-by-side comparison of how ties 11 and 1811, respectively, conform against a bundle B that is generally circular in transverse cross-section. In FIG. 25(*a*), tie 11 is shown cinched around bundle B. Because the entire bottom wall 21 of head 17 is generally flat, strap 15 must enter head 17 at an approximate right angle relative to bottom wall 21. As can be appreciated, the orthogonal entry angle of strap 15 into head 17 creates a significant gap G between tie 11 and the circular bundle B around which it is cinched, which is highly undesirable.

By comparison, in FIG. 25(*b*), tie 1811 is shown cinched around the same bundle B. Due to the inclusion of relief 1837, strap 1815 can be slightly bent, or curved, to conform against bottom wall 1821. As a result, strap 1815 is capable of entry into head 1817 at an acute (i.e., more horizontal) angle and, as such, more closely conforms with the natural outer configuration of bundle B. Accordingly, a gap G' is created between head 1817 and bundle B that is considerably less than the gap G created between head 17 and bundle B.

The embodiments of the present invention described above are intended to be merely exemplary and those skilled in the art shall be able to make numerous variations and modifications to it without departing from the spirit of the present invention. For example, it is to be understood that, whereas the cable ties of the present invention are of the serrated-strap variety, the principles of the present invention could readily be applied to constructing cable ties of the ladder-strap variety. All such variations and modifications are intended to be within the scope of the present invention as defined in the appended claims.

What is claimed is:

1. A cable tie comprising:

(a) a strap, the strap being an elongated flexible member that comprises a front end, a rear end, a top surface, a bottom surface, a pair of side members, and a longitudinal axis, the strap additionally comprising a connective segment at its front end, the connective segment having a width; and (b) a front portion insert-molded onto the connective segment of the strap, the front portion comprising a head, the head being adapted to cooperate with the strap to form a locked closed loop;

(c) wherein the connective segment of the strap is shaped to include a mechanical interlocking element between the strap and the front portion, the mechanical interlocking element including at least one cutout formed into at least one side member, the at least one cutout narrowing the width of the connective segment at some point along its length from the front end to the rear end, the at least one cutout acting as an anchor to preclude separation of the strap from the front portion.

2. The cable tie as claimed in claim 1 wherein the mechanical interlocking element is in a form of a first pair of cutouts that are spaced in from the front end of the strap, each of the first pair of cutouts being formed into a corresponding side member of the strap.

3. The cable tie as claimed in claim 2 wherein the first pair of cutouts are formed as mirror images of one another about the longitudinal axis of the strap.

4. The cable tie as claimed in claim 2 wherein the first pair of cutouts are disposed in an offset relationship relative to one another about the longitudinal axis of the strap.

5. The cable tie as claimed in claim 2 wherein each of the first pair of cutouts is semi-circular in transverse cross-section.

6. The cable tie as claimed in claim 2 wherein each of the first pair of cutouts is triangular in transverse cross-section.

7. The cable tie as claimed in claim 2 wherein each of the first pair of cutouts is square-shaped in transverse cross-section.

8. The cable tie as claimed in claim 2 wherein each of the first pair of cutouts is quarter-elliptical in transverse cross-section.

9. The cable tie as claimed in claim 2 wherein each of the first pair of cutouts is rectangular in transverse cross-section.

10. The cable tie as claimed in claim 9 wherein a portion of each side member between the front end and its corresponding cutout is rounded.

11. The cable tie as claimed in claim 2 wherein the mechanical interlocking element additionally includes a second pair of cutouts that are spaced in from the front end of the strap, each of the second pair of cutouts being formed into a corresponding side member of the strap in a spaced apart relationship relative to the first pair of cutouts.

12. The cable tie as claimed in claim 2 wherein the strap is additionally shaped to define a transverse hole, the transverse hole being spaced in from each of the pair of side members.

13. The cable tie as claimed in claim 12 wherein the transverse hole is offset from the first pair of cutouts.

14. The cable tie as claimed in claim 1 wherein the mechanical interlocking element includes first and second sets of continuously connected cutouts, each set of continuously connected cutouts being formed into a corresponding side member of the strap.

15. The cable tie as claimed in claim 14 wherein each of the first and second sets of continuously connected cutouts extend to the front end of the strap.

16. The cable tie as claimed in claim 15 wherein each of the first and second sets of continuous cutouts are formed as mirror images of one another about the longitudinal axis of the strap.

17. A cable tie comprising:

(a) a strap, the strap being an elongated flexible member that comprises a front end, a rear end, a top surface, a bottom surface and a pair of side members; the strap additionally comprising a connective segment at its front end and a maximum width; and (b) a front portion insert-molded onto the connective segment of the strap, the front portion comprising a head, the head being adapted to cooperate with the strap to form a locked closed loop;

(c) wherein the connective segment of the strap is shaped to include a mechanical interlocking element between the strap and the front portion, the mechanical interlocking element including at least one at least one hole that is spaced in from each of the pair of side members, the at least one hole having a maximum width that is no greater than 40% of the maximum width of the strap;

wherein the mechanical interlocking element includes a transverse hole that is elliptical in transverse cross-section, the transverse hole being spaced in from each of the pair of side members;

wherein the elliptical hole extends in from the front end of the strap by means of a narrow channel.

* * * * *